US008548190B2

(12) United States Patent
Hori et al.

(10) Patent No.: US 8,548,190 B2
(45) Date of Patent: Oct. 1, 2013

(54) COMPOSITE SPEAKER

(75) Inventors: Masashi Hori, Gifu (JP); Kuniyuki Kobayashi, Gifu (JP); Hiromi Saotome, Gifu (JP); Masahiro Iwata, Gifu (JP)

(73) Assignee: FPS Inc., Gifu (JP)

( * ) Notice: Subject to any disclaimer, the term of this patent is extended or adjusted under 35 U.S.C. 154(b) by 0 days.

(21) Appl. No.: 13/517,277

(22) PCT Filed: Jun. 4, 2010

(86) PCT No.: PCT/JP2010/059564

§ 371 (c)(1),
(2), (4) Date: Jun. 20, 2012

(87) PCT Pub. No.: WO2011/077770

PCT Pub. Date: Jun. 30, 2011

(65) Prior Publication Data

US 2012/0263338 A1 Oct. 18, 2012

(30) Foreign Application Priority Data

Dec. 21, 2009 (JP) ..... 2009-289439

(51) Int. Cl.
*H04R 25/00* (2006.01)

(52) U.S. Cl.
USPC ..... 381/396; 381/152; 381/398

(58) Field of Classification Search
USPC ..... 381/86, 152, 337, 353, 354, 386, 381/389, 396, 398, 412, 420, 431; 181/150, 181/171, 172, 199
See application file for complete search history.

(56) References Cited

U.S. PATENT DOCUMENTS 4,506,117 A * 3/1985 Fresard ..... 381/162
6,487,300 B1 11/2002 Lee et al.

(Continued)

FOREIGN PATENT DOCUMENTS

JP 57-168382 10/1982
JP 2002263578 9/2002

(Continued)

OTHER PUBLICATIONS

International Search Report in International Application No. PCT/JP2010/059564 mailed Jul. 6, 2010, 4 pages.

(Continued)

*Primary Examiner* — Huyen D Le
(74) *Attorney, Agent, or Firm* — Thomas|Horstemeyer, LLP

(57) ABSTRACT

A composite speaker is provided capable of obtaining larger sound output than that of a conventional flat panel speaker and flat speaker when input with an audio signal of the same strength. The composite speaker includes: one magnet or a plurality of magnets disposed at predetermined intervals to each other; a yoke for forming a magnetic circuit with a magnetic gap to the magnets; a voice coil disposed in a gap between the magnets and the yoke so as to interlink with the magnetic circuit; a diaphragm with the voice coil fixed to one face thereof; a frame that supports the diaphragm at peripheral edge portions of the diaphragm and houses the magnets and the yoke; a speaker base plate fixed to the frame at the side of the frame supporting the diaphragm or at the side of the frame opposite to the side supporting the diaphragm; and a phase rotation member configured by an elastic member provided between the speaker base plate and the yoke; wherein sound is generated from both the diaphragm and the speaker base plate.

13 Claims, 21 Drawing Sheets

(56) References Cited

U.S. PATENT DOCUMENTS

| | | | | |
|---|---|---|---|---|
| 2008/0304694 | A1 | 12/2008 | Hayashi | |
| 2009/0116681 | A1 | 5/2009 | Sadaie et al. | |
| 2011/0243367 | A1* | 10/2011 | Lee et al. | 381/398 |
| 2011/0255732 | A1* | 10/2011 | Kwon et al. | 381/396 |

FOREIGN PATENT DOCUMENTS

| | | | |
|---|---|---|---|
| JP | 2004289772 | | 10/2004 |
| JP | 2004312643 | | 11/2004 |
| JP | 2004533957 | | 11/2004 |
| JP | 2005094377 | | 4/2005 |
| JP | 2005198217 | | 7/2005 |
| JP | 2005217778 | | 8/2005 |
| JP | 2008306380 | | 12/2008 |
| JP | 2009118020 | | 5/2009 |
| WO | WO0078095 | | 12/2000 |
| WO | 2009133986 | A1 | 11/2009 |

OTHER PUBLICATIONS

Extended European Search Report in Appln No. 10839007.1 dated May 6, 2013, 6 pages.

* cited by examiner

COMPOSITE SPEAKER

CROSS-REFERENCE TO RELATED APPLICATION

This application is the National Stage of International Application no. PCT/JP2010/059564, filed Jun. 4, 2010, and claims priority to Japanese Patent Application No. 2009-289439, filed Dec. 21, 2009, the contents of both of which are incorporated by reference as if fully set forth herein.

DESCRIPTION

1. Technical Field

The present invention relates to a speaker.

2. Background Art

A flat panel speaker including, for example: exciters having a magnetic circuit, a voice coil and a bobbin for holding the voice coil, disposed at both right and left end portions, or both top and bottom end portions of a thin display device; and a light transmitting flat panel disposed over the entire face of the thin display device and doubling as a diaphragm that is vibrated by the exciters and performs warping vibration is described (see Japanese Patent Applications Laid-Open (JP-A) No. 2004-289772, and JP-A No. 2004-312643).

Another example of a flat panel speaker is a loudspeaker drive units (see Japanese National-Phase Publication No. 2002-533957) comprising a visible display screen, a resonating panel-shaped member of which at least a portion is transparent, disposed adjacent to the display screen such that the display screen can be seen through the transparent portion, and vibration excitation means that functions as an acoustic radiator driving the panel member so as to cause the panel member to resonate. There are also displays (see JP-A No. 2005-94377) configured with: a thin panel-shaped main body; a vibrating body attached to a first face side of the main body that imparts vibrations to the main body, causing the main body to undergo warping vibration according to the vibration frequency of the vibrating body; a support fixing that supports the main body fixed to the ground, wherein the support fixing is formed with a vibration insulating body having vibration insulating properties with respect to the fixed body, a connector is formed on a first face side of the main body, and a connector at an end portion of an electrical cable is connected to the main body connector to transmit sound signals to the vibrating body.

A flat acoustic transducer (see WO2000/078095 Pamphlet), wherein permanent magnets formed in flattened rectangular shapes are disposed in a yoke such that magnetic pole faces of different magnetic polarity are positioned alternately, and helical shaped coil pairs are disposed at both faces of a diaphragm such as to correspond to each of the permanent magnets, is also included in an Example of a flat panel speaker.

There is also a vibro-acoustic converter (see JP-A No. 2002-263578) which includes: a case with a space portion in an internal wall face; a sound generation diaphragm with an outside end portion fixed to an upper end portion of the case; a voice coil wound in a circular cylindrical shape and fixed onto a lower end of the diaphragm; a plate with an outside end portion fixed to a bottom end portion of the case; a magnetic circuit provided to a bottom portion of the voice coil and configured with a magnet magnetized in a vertical direction with an upper plate and a yoke attached to the magnet to form a magnetic field; a circular cylindrical weight fixed to an outer peripheral face of the yoke; a suspension spring for supporting the magnetic circuit and the weight, and fixed to an inner peripheral face of the case; and a magnetic fluid of a specific viscosity disposed between the magnetic circuit and the plate so as to acting as a damping member when the suspension spring displaces in the vertical direction.

DISCLOSURE OF INVENTION

Technical Problem

An object of the present invention is to provide a composite speaker that improves low pitched sound generation, an aspect that is difficult for conventional compact thin speakers, and that improves on sound localization, and aspect that is difficult for flat panel speakers.

Solution to Problem

A first aspect of the invention relates to a composite speaker including: plural magnets disposed at predetermined intervals to each other; a yoke for forming a magnetic circuit with a magnetic gap to the magnets; voice coils disposed in a gap between the magnets and the yoke so as to interlink with the magnetic circuit; a diaphragm with the voice coils fixed to one face thereof; a frame that supports the diaphragm at peripheral edge portions thereof and houses the magnets and the yoke; a speaker base plate fixed to the frame at the side thereof supporting the diaphragm or the side opposite to the side supporting the diaphragm; and an elastic member provided between the speaker base plate and the yoke; wherein sound is generated from both the diaphragm and the speaker base plate.

A second aspect of the invention relates to the composite speaker of the first aspect wherein the magnets are disposed in a row such that two adjacent magnet poles are the reverse of each other.

A third aspect of the invention relates to the composite speaker of the first aspect or the second aspect further including a back plate provided between the speaker base plate and both the frame and the elastic member.

A fourth aspect of the invention relates to the composite speaker of any one of the first aspect to the third aspect wherein the speaker base plate has a flat plate shape with a high order curve profile represented by the following equation, wherein the center point of the speaker base plate is at the origin of xy coordinates, r is the radius, and i is a number from 5 to 7:

$$r^i=|x|^i+|y|^i$$

A fifth aspect of the invention relates to the composite speaker of any one of the first aspect to the fourth aspect wherein the diaphragm and the frame are formed from aluminum alloy.

Advantageous Effects of Invention

In the composite speaker of the first aspect, both the diaphragm and the magnets vibrate when an audio current is input to the voice coil. Medium and high pitched sound is emitted from the diaphragm itself, and low pitched sound components are transmitted to the speaker base plate through the frame. The phase of vibration of the magnets is the opposite to the vibration phase of the diaphragm. However the phase is rotated by the elastic member and transmitted to the speaker base plate.

According to the first aspect of the invention, since the diaphragm and the speaker base panel respectively emit medium and high pitched sound and low pitched sound, a composite speaker is accordingly provided capable of sound localization and generating a rich low pitched sound component.

In the composite speaker of the second aspect, since the magnets are disposed in a row such that two adjacent magnet poles are the reverse of each other, magnetic flux lines are formed from the south pole of one of the two adjacent magnets towards the north pole of the other adjacent magnet. Hence the diaphragm and the magnets accordingly vibrate due to interaction between the changing magnetic field generated in the voice coil when an audio signal is input to the voice coil and the magnetic flux lines, and the audio signal is thereby converted into sound.

High frequencies out of the vibrations generated in the magnets are absorbed by the elastic member. However the low frequencies therein propagate to the speaker base plate through the elastic member. Low frequencies in the vibrations generated in the diaphragm propagate through the frame to the speaker base panel. At this point, vibrations of the magnets are in the opposite phase to vibrations of the diaphragm, however the phase of the vibrations is reversed by the elastic member and the vibrations propagate to the speaker base panel as vibrations in the same phase as the vibrations of the diaphragm.

High pitched sound consequently emits directly forwards from the diaphragm, however low pitched sound propagates through the speaker base panel.

According to the third aspect of the invention, as stated above, since the magnets and the yoke do not remain on the speaker base panel when the frame is detached from the speaker base panel, a composite speaker is provided that can be handled more easily than a composite speaker that does not have a back panel.

In the speaker according to the fourth aspect of the invention, since the base panel has a semi-stadium shaped flat plane shape with an outline of a 5 to 7 order curve shape, the base panel vibrates irregularly with a high degree of chaos when excited by the diaphragm and the magnets, such that degeneration does not occur, and the intrinsic frequency distribution follows a Wigner distribution.

A composite speaker is consequently provided capable of more faithfully reproducing not only low pitched sound but also high pitched sound in comparison to cases in which the speaker base panel has a flat plane shape other than the flat plane shape described above.

According to the fifth aspect of the invention, due to the diaphragm and the frame being formed from an aluminum series alloy, a composite speaker is provided that can dissipate heat generated in the voice coil particularly efficiently.

DESCRIPTION OF EMBODIMENTS

1. First Exemplary Embodiment 1-1 Configuration

Figure 1:
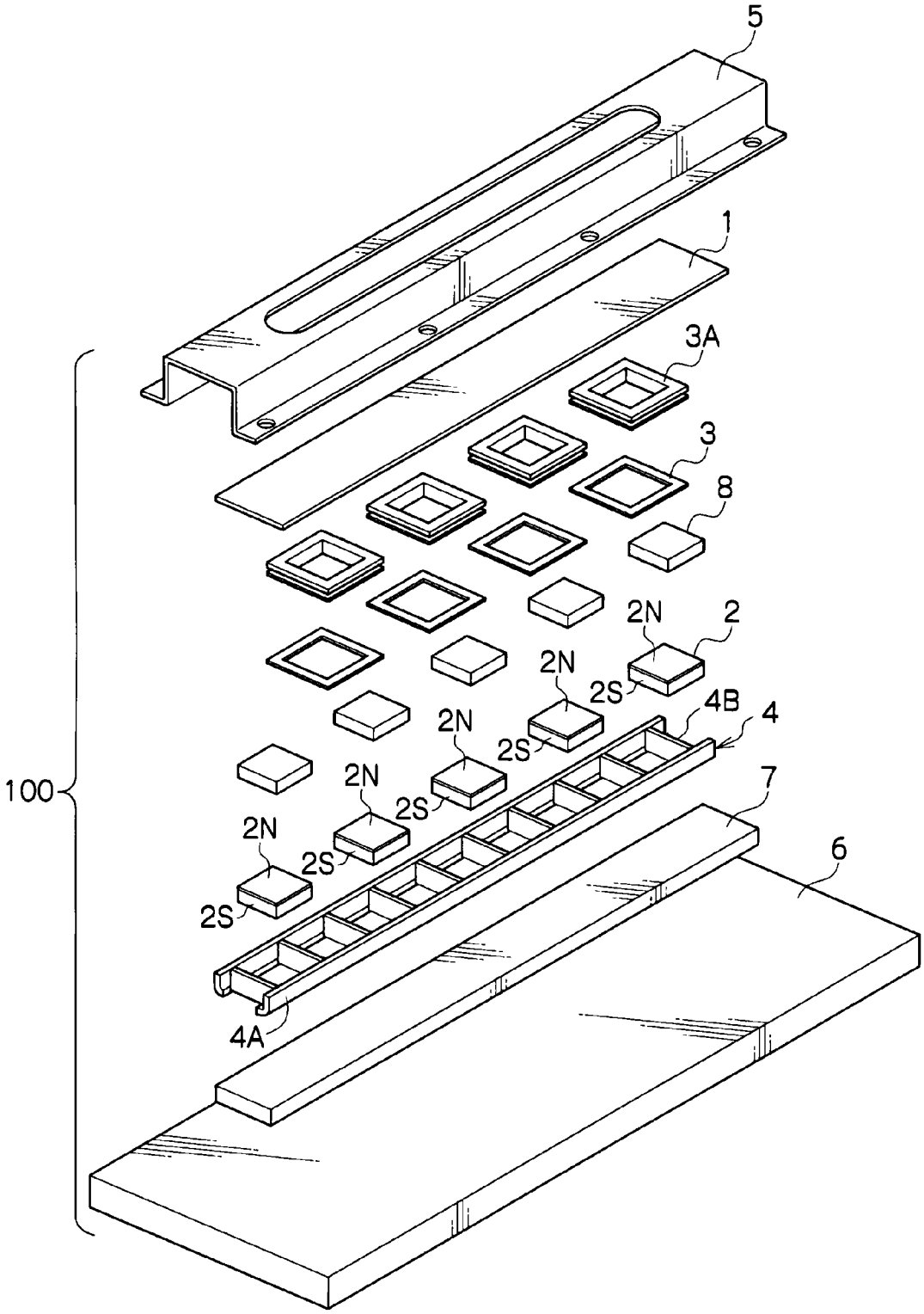
FIG. 1 is an exploded perspective view illustrating the configuration of a composite speaker according to a first exemplary embodiment.
Figure 2:
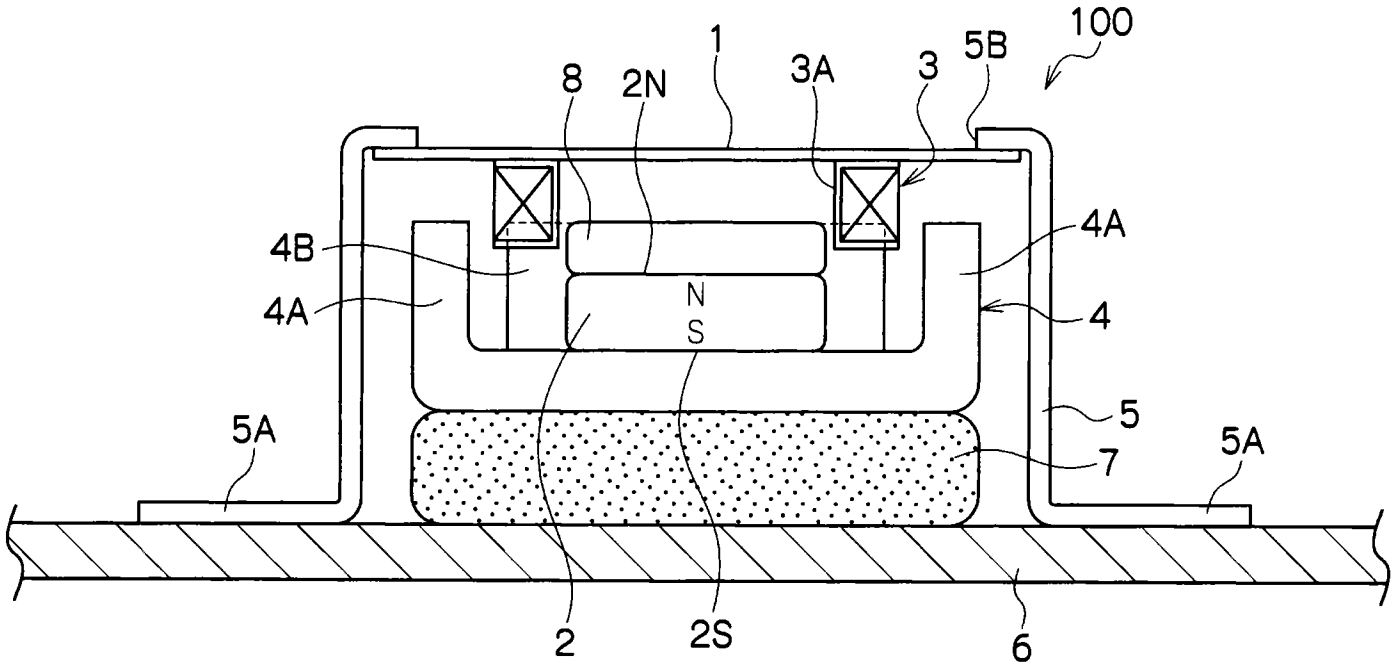
FIG. 2 is a cross-section taken along the width direction illustrating a composite speaker according to the first exemplary embodiment.
Figure 3:
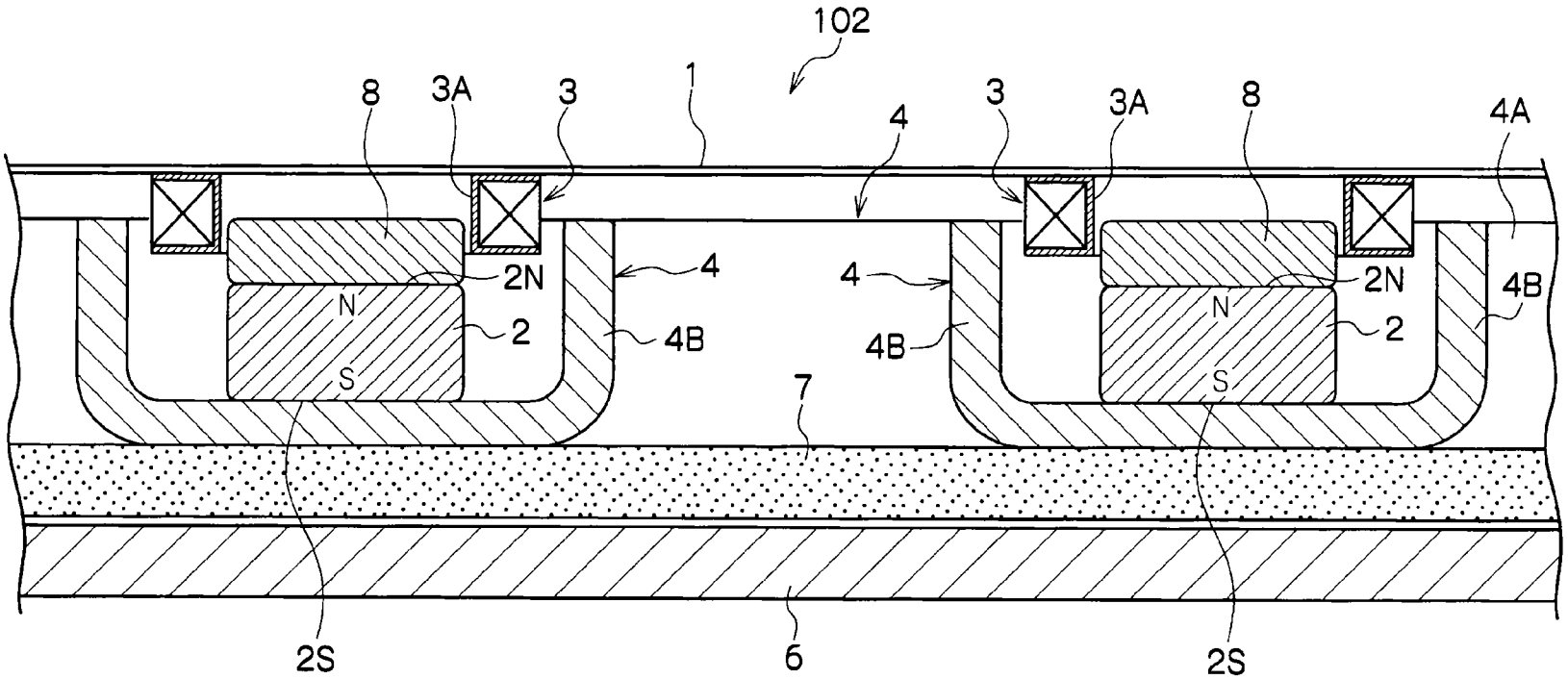
FIG. 3 is a cross-section taken along the length direction illustrating a composite speaker according to the first exemplary embodiment.
Figure 4:
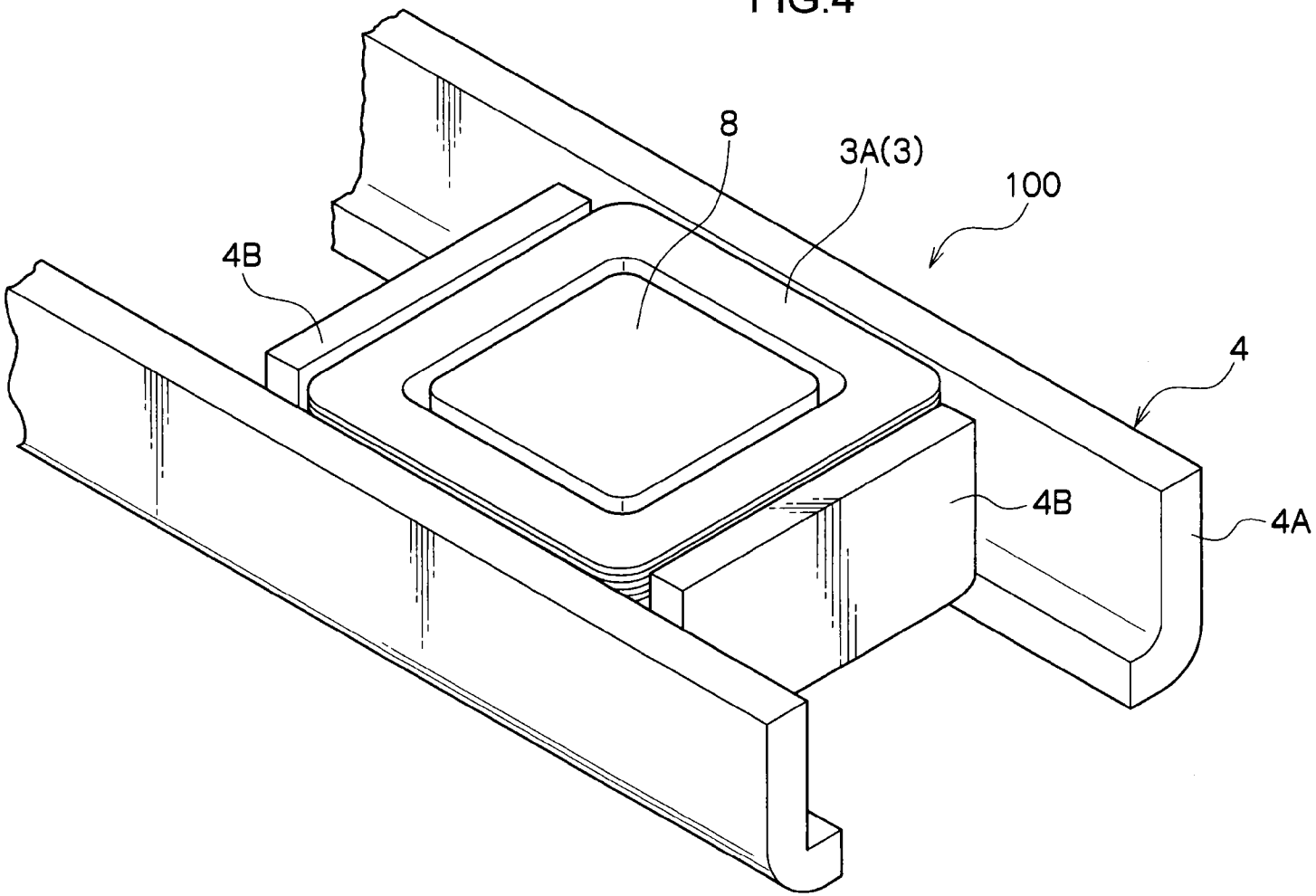
FIG. 4 is a perspective view illustrating the relative positional relationship of a yoke, a voice coil and a pole piece mounted to a north pole of a magnet in a composite speaker according to the first exemplary embodiment.

An example of a composite speaker according to the present invention is explained below. A composite speaker 100 according to the present exemplary embodiment, as shown in FIG. 1 to FIG. 3, includes: a set of magnets 2 disposed in a row at a fixed interval from each other; a sheet shaped diaphragm 1 formed in a rectangular flat plane shape with long sides along the row array direction of the magnets 2; voice coils 3 provided to the face of the diaphragm 1 on the side facing the magnets 2; a yoke 4 in contact with magnetic poles 2S of the magnets 2; a frame 5 that supports the diaphragm 1 at peripheral edge portions thereof and houses the magnets 2 and the yoke 4; a speaker base plate 6 to which the frame 5 is fixed; and an elastic member 7 interposed between the yoke 4 and the speaker base plate 6 to support the yoke 4.

Each of the magnets 2 is formed in substantially square plate shape, magnetized such that one face is a magnetic pole 2N that is a north pole, and the other face is the magnetic pole 2S that is a south pole. The magnets 2 are, as shown in FIG. 1 to FIG. 3, attached to the yoke 4 such that the magnetic poles 2N face the diaphragm 1, in other words the magnets 2 are attached with the magnetic poles 2N facing upwards in FIG. 1 to FIG. 3. Note there is no limitation to disposing the magnets 2 in the configuration as illustrated in FIG. 1 to FIG. 3 with the magnetic poles 2N facing upwards, and the magnets 2 may be disposed such that the north poles 2N and the south poles 2S face up alternately, or such that the north poles 2N and the south poles 2S are disposed at random. The shape of the magnets 2 is not limited to a substantially square shape, and the magnets 2 may be configured with a rectangular plate shape.

Pole pieces 8 being formed from a ferromagnetic body and having flat face profile congruent to the respective magnets 2 are attached to the magnetic poles 2N of the magnets 2. At least a portion of each of the pole pieces 8 intrudes inside the respective voice coil 3.

The yoke 4 is formed from a ferromagnetic body, and as shown in FIG. 1 to FIG. 4, has a pair of side edges running along the length direction that bend around upwards towards the diaphragm 1 so as to surround two mutually parallel faces of the magnets 2, configuring first bent portions 4A. The bottom portion of the yoke 4 also bends around upwards such that the other two faces of the magnets 2 are also sandwiched by the yoke, configuring second bent portions 4B. The periphery of the magnets 2 is hence surrounded by the first bent portions 4A and the second bent portions 4B. The first bent portions 4A and the second bent portions 4B are configured with a height such that the top edges of the first bent portions 4A and the second bent portions 4B are opposite the respective pole pieces 8.

The frame 5 is a member formed overall in a hat shape, and with flange portions 5A formed at the opening side of the hat shaped member for fixing to the speaker base plate 6. An opening 5B is provided on the basal side. The diaphragm 1 is fixed to the opening 5B.

The diaphragm 1 and the frame 5 are formed from aluminum alloy. Examples of aluminum alloys that can be employed include 1000 series, 2000 series, 3000 series, 5000 series, 6000 series and 7000 series aluminum alloys. Heat generated in the composite speaker 100 is thereby efficiently externally radiated through the diaphragm 1 and the frame 5. While omitted in FIG. 1, the cooling efficiency can be further raised if fins are attached to the surface of the frame 5. Various types of stainless steel can also be employed for the diaphragm 1 and the frame 5.

An elastic material molded body formed by molding an elastic material selected from a thermoplastic elastomer, a vulcanized rubber and a soft resin into a block shape, a sheet shape or a plate shape may be employed as the elastic member 7. An elastic foam material body formed by foaming one of the above elastic materials into a block shape, a sheet shape or a plate shape may also be employed as the elastic member 7.

Examples of such thermoplastic elastomers include polyolefin elastomers such as EPDM, a polyurethane elastomer, a polyamide elastomer, a polyester elastomer and an epoxy resin elastomer. Examples of diene rubbers include a natural rubber, a butadiene rubber, a styrene butadiene rubber, an isoprene rubber, a chloroprene rubber and a nitryl rubber. Examples of soft resins include a low density polyethylene resin and a soft vinyl chloride resin, a vinyl chloride-vinyl acetate copolymer, an ethylene-vinyl alcohol copolymer, and an ethylene-vinyl acetate copolymer.

Note that the elastic material molded body and the elastic foam material body may be a member integrally formed spanning the entire length of the composite speaker 100 as shown in FIG. 1 and FIG. 3, or may be a member configured by distributed molded blocks.

The coefficient of elasticity and the volume of the elastic member 7 are determined according the force to act on the yoke 4.

Coils formed by winding wire on bobbins 3A are used as the voice coils 3, as shown in FIG. 1 and FIG. 3, however configuration may be made with hollow coils having no bobbin.

The voice coils 3 are fixed to the face of the diaphragm 1 that faces towards the magnets 2.

1-2 Operation

Operation of the composite speaker 100 according to the first exemplary embodiment is explained below.

In the composite speaker 100 the magnets 2 are disposed such that their north magnetic poles 2N face the diaphragm 1, and so magnetic flux lines are formed individually for each of the magnets 2.

As described above, the first bent portions 4A and the second bent portions 4B of the yoke 4 bend around such that the top edges of the first bent portions 4A and the second bent portions 4B oppose the side faces of the pole pieces 8 formed from ferromagnetic bodies. The voice coils 3 are disposed between the pole pieces 8 and both the first bent portions 4A and the second bent portions 4B. Hence, as shown by arrows A of FIG. 8, the magnetic flux lines emitted from the magnetic poles 2N of the magnets 2 pass through the pole pieces 8 and cut across the voice coils 3, and then pass through the first bent portions 4A or the second bent portions 4B to reach the magnetic poles 2S of the magnets 2. The wires of the voice coils 3 therefore interlink with the magnetic flux lines formed by the magnets 2.

Figure 8:
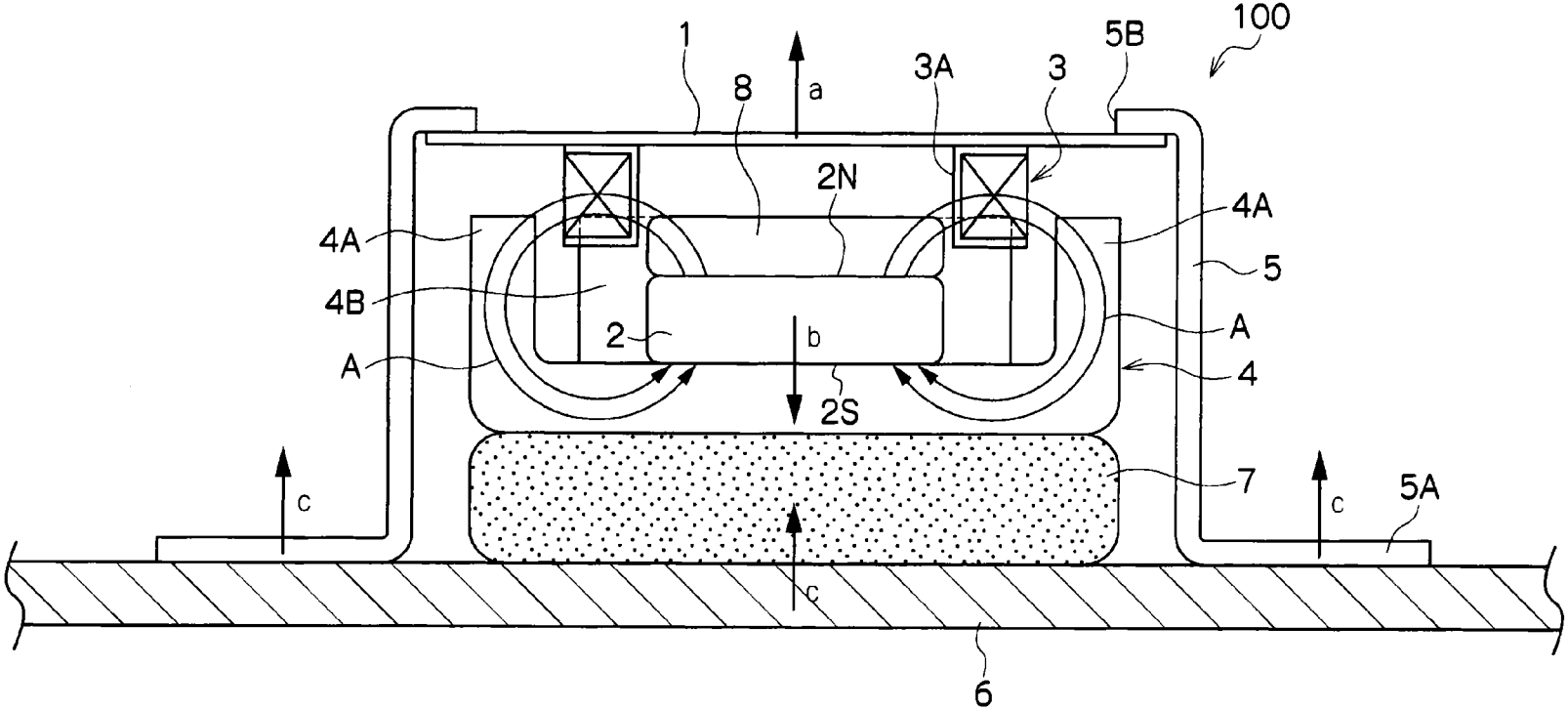
FIG. 8 is an explanatory diagram for explaining the operation of a composite speaker according to the first exemplary embodiment.

The magnets 2 are also not directly fixed to the speaker base plate 6 and are instead attached through the yoke 4 and the elastic member 7. Therefore when an audio current is input to the voice coils 3, a changing magnetic field is generated in the voice coils 3, and the diaphragm 1 vibrates due to interaction of the changing magnetic field with the magnetic field of the magnets 2. Similarly, the magnets 2 vibrate with the opposite phase to the diaphragm 1. Namely, when the diaphragm 1 and the voice coils 3 respectively deform and displace in the direction of arrow a as shown in FIG. 8 (upwards), the magnets 2 move in the arrow b direction indicated in FIG. 8, downwards in the opposite direction to arrow a.

Accordingly, whereas high pitch components of the vibration of the magnets 2 are absorbed by the elastic member 7, the phase of low pitch components is reversed by the elastic member 7, enabling phase reversal to be achieved by adjusting the coefficient of elasticity and volume of the elastic member 7.

Movement of the magnets 2 in the direction arrow b is reversed by the elastic member 7, so as to be transmitted to the speaker base plate 6 as movement in the arrow c direction that is the same as the direction of arrow a. Accordingly, in combination with the vibration transmitted from the diaphragm 1 through the frame 5, the speaker base plate 6 emits rich sound of low pitch.

2. Second Exemplary Embodiment

Figure 5:
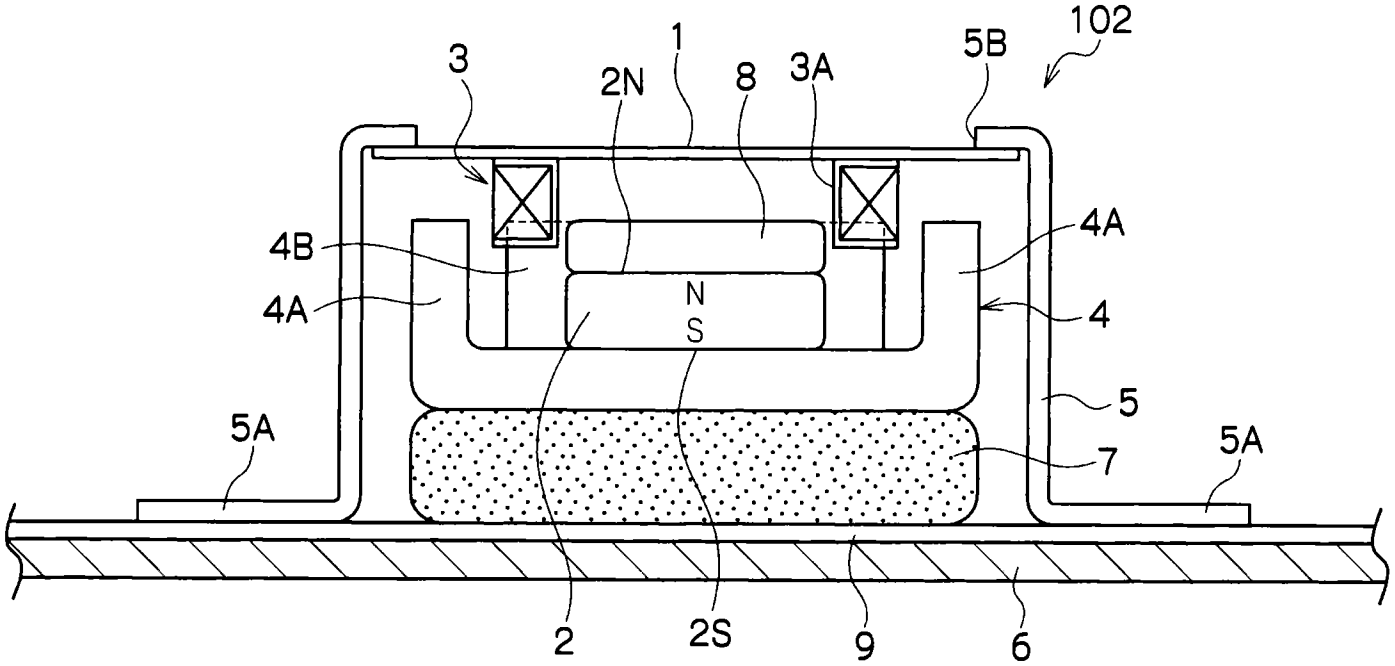
FIG. 5 is a cross-section taken along the width direction of a composite speaker according to a second exemplary embodiment.
Figure 6:
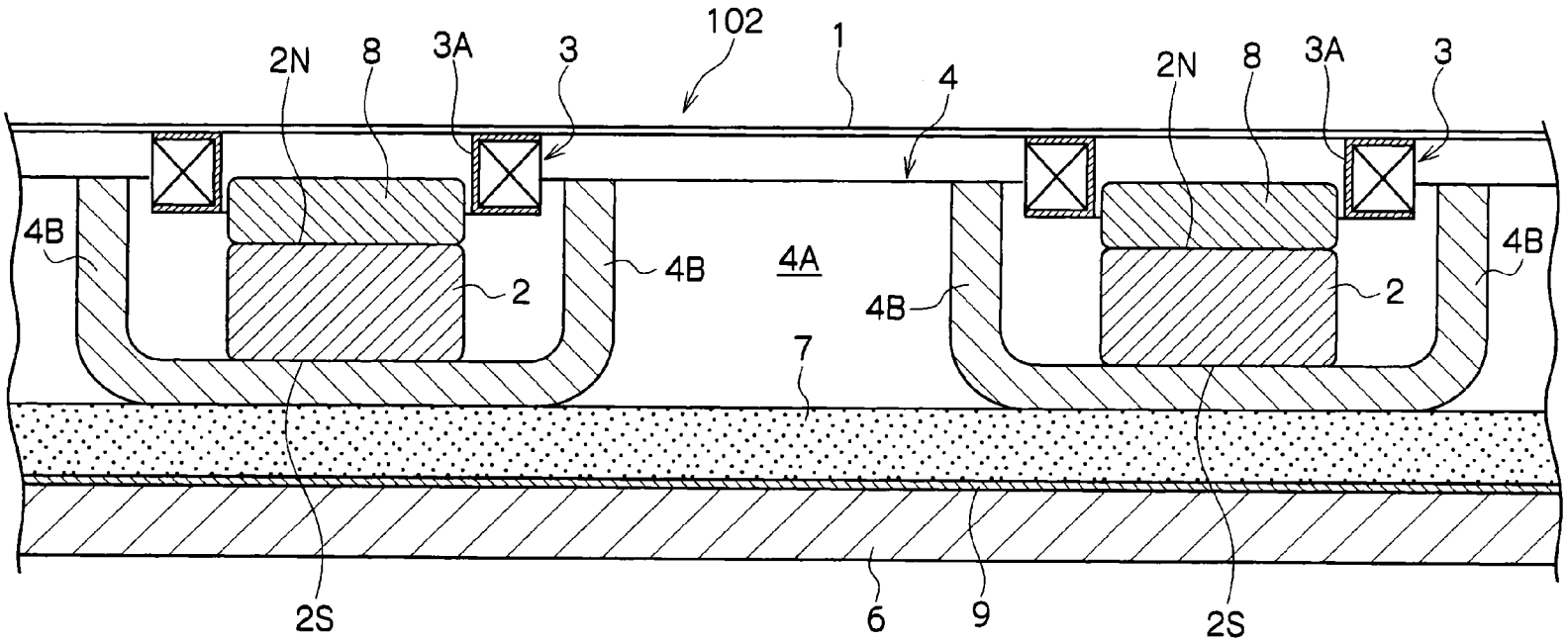
FIG. 6 is a cross-section taken along the length direction of a composite speaker according to the second exemplary embodiment.

Another example of a composite speaker according to the present invention is explained below. In the composite speaker 102 according to the second exemplary embodiment, as shown in FIG. 5, a back plate 9 formed from a thin metal plate is fixed to flange portions 5A of a frame 5, such that a closed cross-section is configured by the diaphragm 1, the frame 5 and the back plate 9. Magnets 2, a yoke 4 and an elastic member 7 are housed inside the closed cross-section.

In the composite speaker 102, the magnets 2, the yoke 4 and the elastic member 7 are detached in a state housed inside the frame 5 when the flange portions 5A of the frame 5 have been detached from the speaker base plate 6. Consequently, the composite speaker 102 can be easily installed in and detached from an audio device, a building or a vehicle even in cases where the speaker base plate 6 is used as a common installation member in a casing of an audio device, or in the interior decor of a building or a vehicle.

The composite speaker 102 has a similar configuration and function to the composite speaker according to the first exemplary embodiment, except for the points described above.

3. Third Exemplary Embodiment

Figure 7:
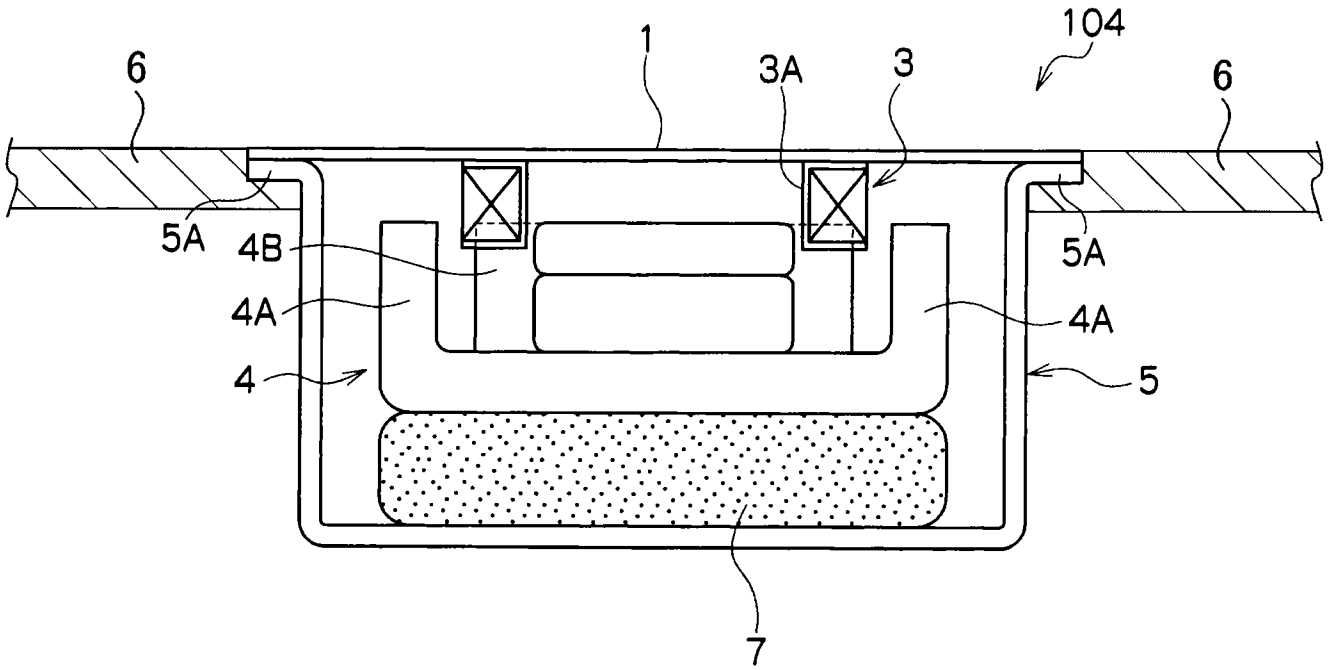
FIG. 7 is a cross-section taken along the width direction of a composite speaker according to a third exemplary embodiment.

An additional example of the composite speaker of the present invention is explained below. As shown in FIG. 7, in a composite speaker 104 of a third exemplary embodiment a diaphragm 1 is fixed to flange portions 5A of a frame 5.

The frame 5 is fixed directly to a speaker base plate 6 positioned to the bottom face side of the frame 5. An elastic member 7 is interposed between a yoke 4 and the bottom face of the frame 5.

Magnets 2, voice coils 3, the yoke 4 and the elastic member 7 are configured as described in the first exemplary embodiment.

In the composite speaker 104 the magnets 2, the yoke 4 and the elastic member 7 are also detached in a state housed inside the frame 5 when the frame 5 is detached from the speaker base plate 6. Consequently, the composite speaker 104 can be easily installed in and detached from an audio device and a building or vehicle even in cases where the speaker base plate 6 is used as a common installation member in a casing of an audio device or in the interior decor of a building or a vehicle.

4. Fourth Exemplary Embodiment

A further example of the composite speaker according to the present invention is explained below.

4-1 Configuration

A composite speaker 106 according to a fourth exemplary embodiment, as shown in FIG. 9 to FIG. 11B, includes: a sheet shaped diaphragm 1 having a rectangular flat plane shape with long sides running along the row array direction of magnets 2 described later; a set of the magnets 2 disposed in a row such that magnetic poles 2S, 2N are opposite one face thereof 1 and two adjacent magnetic poles 2S, 2N are reversed from each other; voice coils 3 disposed in a row along the row array direction of the magnets 2, and provided on the face of the diaphragm 1 at locations so as to face the magnets 2 that have their south magnetic poles 2S facing towards the diaphragm 1 side, in other words provided so as to face every other of the magnets 2; a yoke 4 in contact with the magnetic poles 2N (2S) on the sides of the magnets 2 not facing towards the diaphragm 1; a frame 5 that supports the diaphragm 1 at peripheral edge portions thereof and houses the magnets 2 and the yoke 4; and a speaker base plate 6 serving as a speaker base plate to which the frame 5 is fixed.

An elastic member 7 is interposed between the yoke 4 and the speaker base plate 6.

Figure 13:
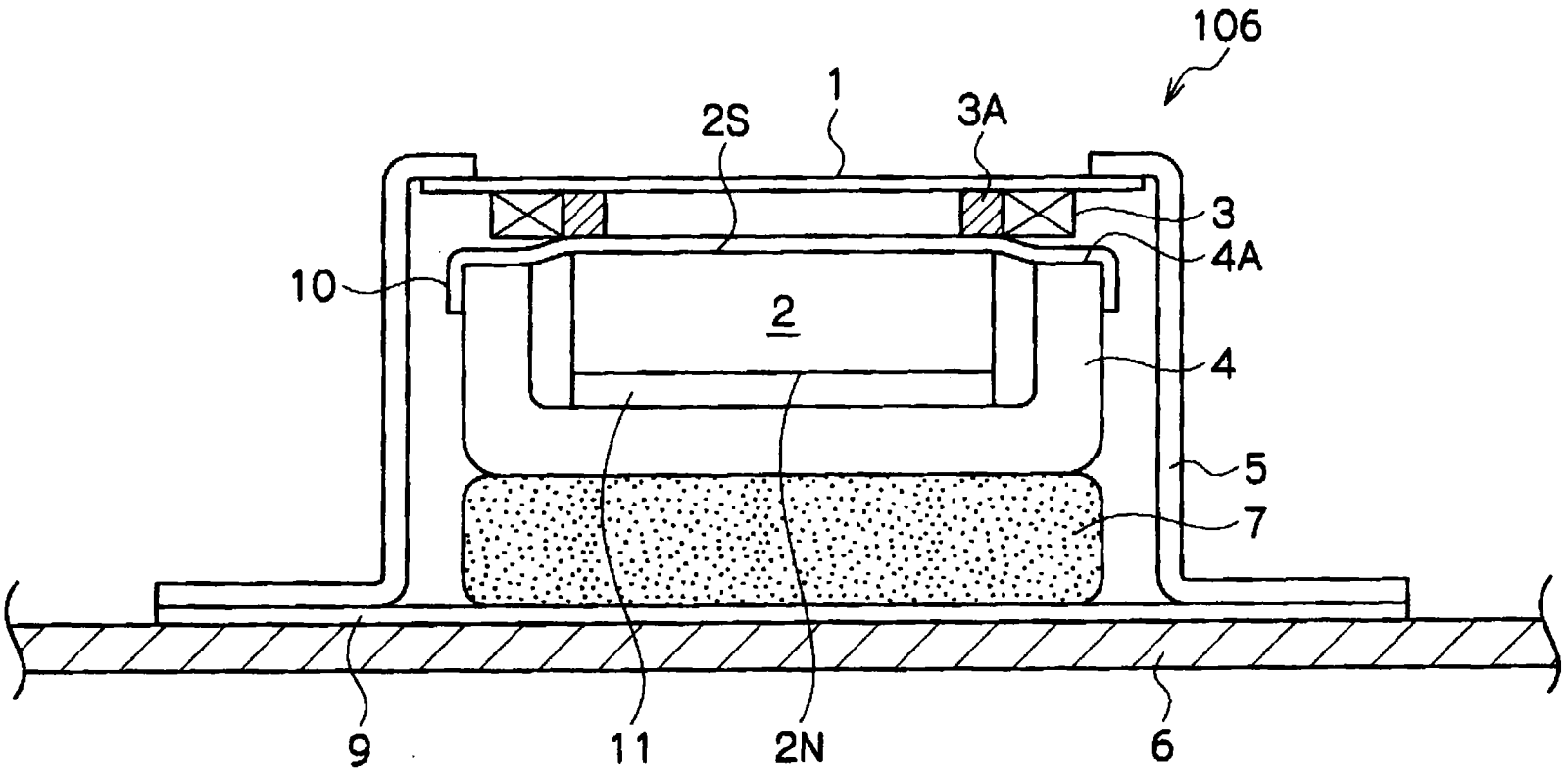
FIG. 13 is an explanatory diagram illustrating a different example of a composite speaker according to the fourth exemplary embodiment.

Note that the composite speaker 106 can be configured as shown in FIG. 13, that is, with a back plate 9 formed from a thin metal plate fixed to the frame 5 on the speaker base plate 6 side thereof, such that a closed cross-section is configured by the diaphragm 1, the frame 5 and the back plate 9. The magnets 2, the yoke 4 and the elastic member 7 are thereby housed inside the closed cross-section. The elastic member 7 is disposed in a position adjacent to the back plate 9 in such a configuration.

Attaching and detaching the frame 5 to and from the speaker base plate 6 is facilitated by the above configuration.

Figure 9:
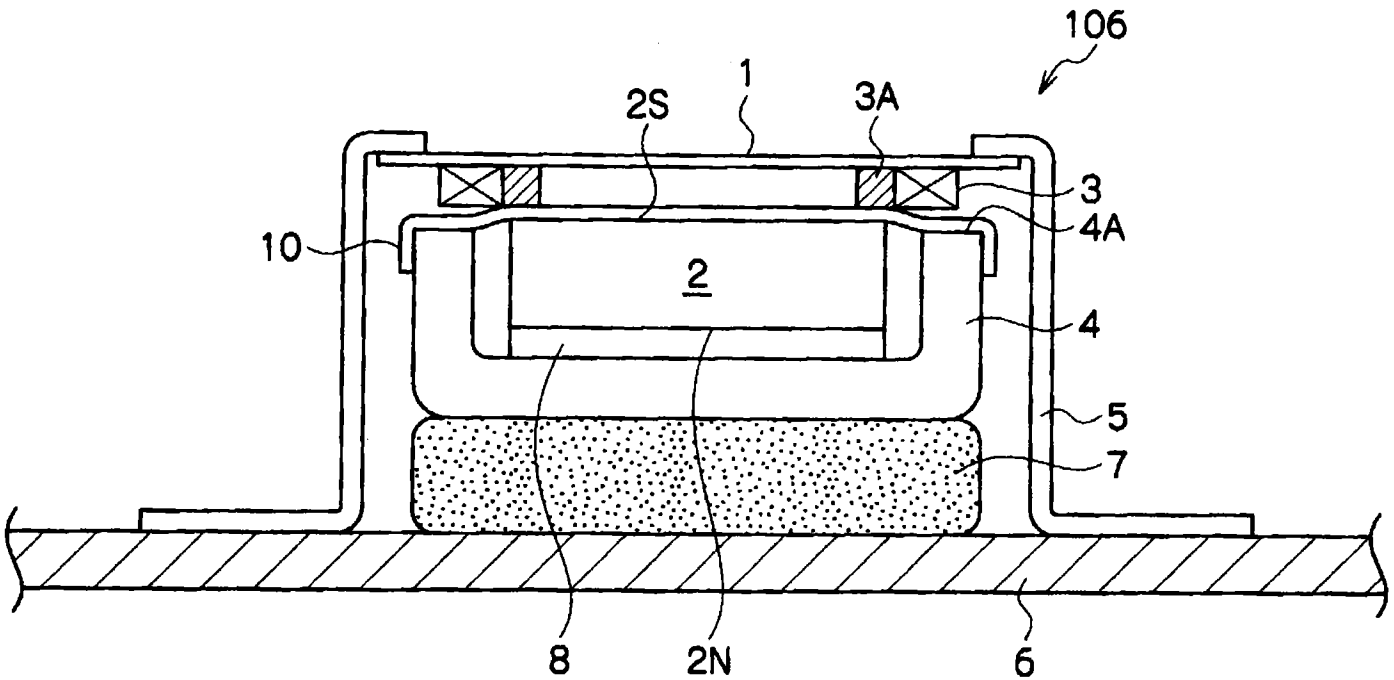
FIG. 9 is a cross-section illustrating a configuration of a composite speaker according to a fourth exemplary embodiment.
Figure 11A:
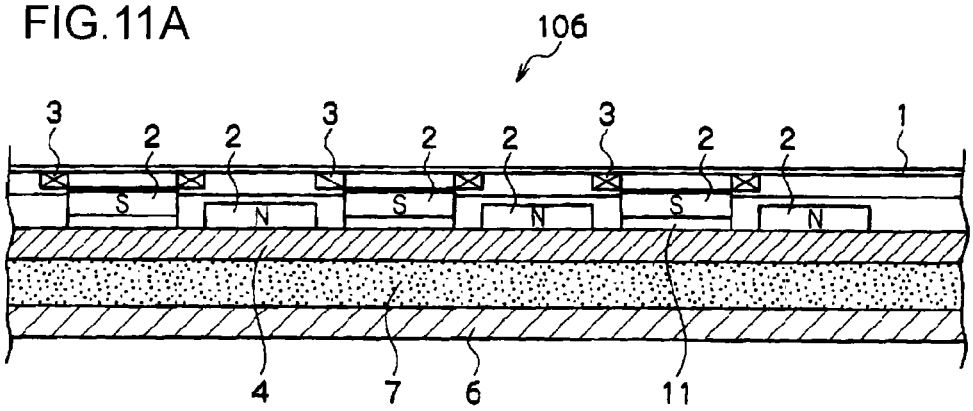
FIG. 11A is a cross-section taken along the length direction of a composite speaker illustrating the positional relationships of voice coils and magnets in a composite speaker according to the fourth exemplary embodiment.
Figure 11B:
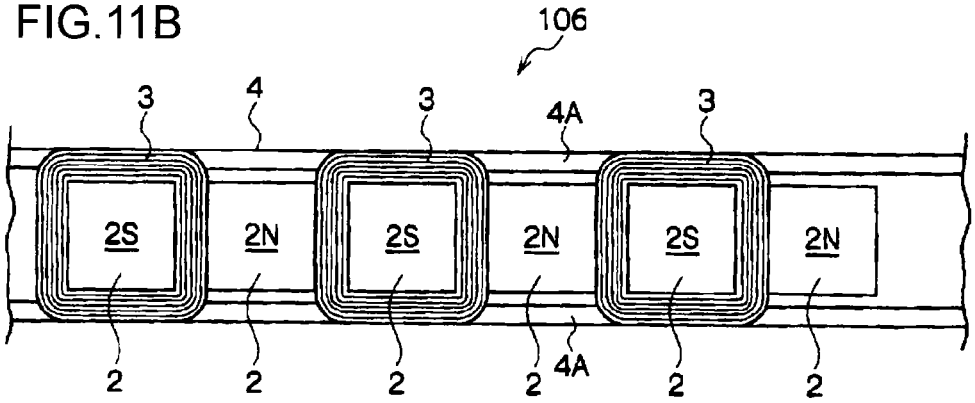
FIG. 11B is a plan view showing a cross-section taken along the length direction of a composite speaker illustrating the positional relationships of voice coils and magnets in a composite speaker according to the fourth exemplary embodiment.

As shown in FIG. 9, FIG. 11A and FIG. 11B, an iron plate 11 is inserted between the yoke 4 and each of the magnets 2 that have their magnetic poles 2S facing the diaphragm 1, namely facing the voice coils 3, thereby adjusting the level of the magnets 2.

As shown in FIG. 9 to FIG. 11A, the yoke 4 is formed from a ferromagnetic body with both side edges 4A bending around towards the diaphragm 1, so as to form a gutter shape housing the magnets 2. Non-woven fabric 10 is inserted between the voice coils 3 and both the yoke 4 and the magnets 2 such that when the magnets 2 and the diaphragm 1 are vibrating the magnetic poles 2S (2N) of the magnets 2 do not make direct contact with the voice coils 3.

The diaphragm 1 and the frame 5 are configured as explained in the first exemplary embodiment. The same materials as mentioned in the first exemplary embodiment are also employed for the elastic member 7.

Figure 10:
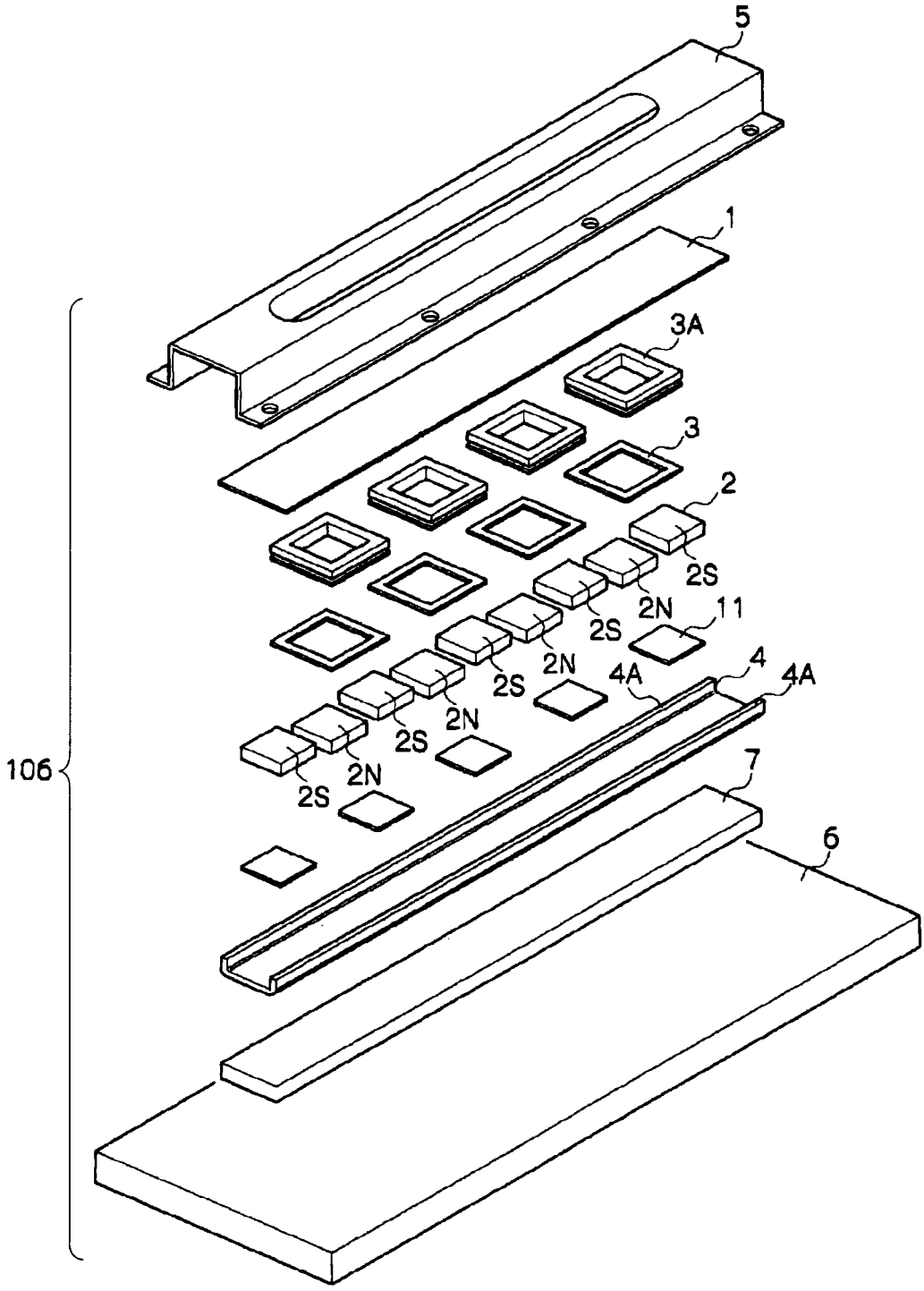
FIG. 10 is an exploded perspective view illustrating a configuration of a composite speaker according to the fourth exemplary embodiment.

Note that the elastic material molded body and the elastic foam material body may be a member integrally formed spanning the entire length of the composite speaker 106 as shown in FIG. 10, or may be a member configured by distributed molded blocks.

The coefficient of elasticity and the volume of the elastic member 7 can be determined according to the force acting on the yoke 4.

As shown in FIG. 9 and FIG. 10, coils formed by winding wire on bobbins 3A are used as the voice coils 3. However hollow coils having no bobbin can be employed as the voice coils 3.

Figure 12A:
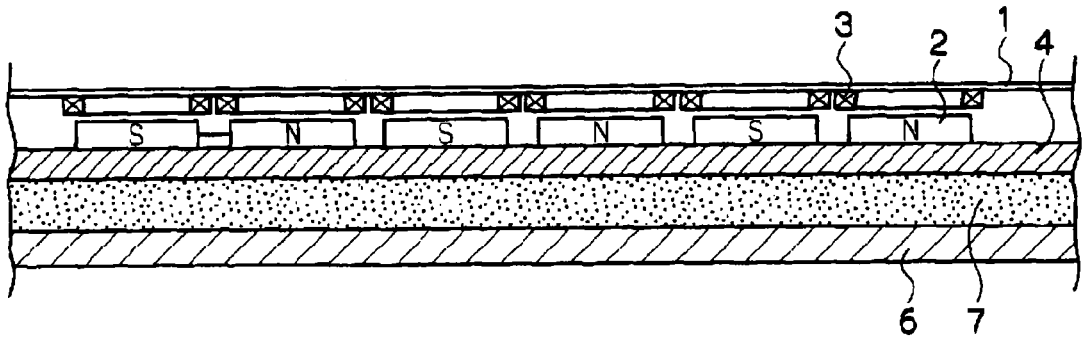
FIG. 12A is a cross-section taken along the length direction of a composite speaker illustrating the positional relationships of voice coils and magnets in a different example of a composite speaker according to the fourth exemplary embodiment.
Figure 12B:
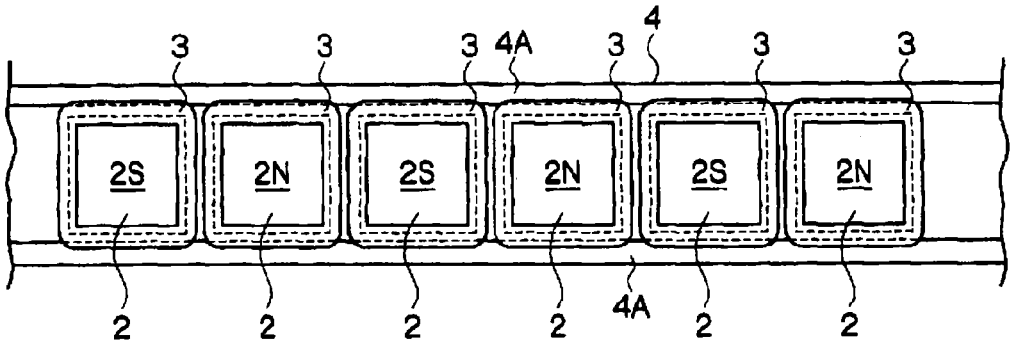
FIG. 12B is a plan view showing a cross-section taken along the length direction of a composite speaker illustrating the positional relationships of voice coils and magnets in a different example of a composite speaker according to the fourth exemplary embodiment.

Note that in the composite speaker of the fourth exemplary embodiment each of the voice coils 3 may be provided for each of the magnets 2, as shown in FIG. 12A and FIG. 12B. In the embodiment illustrated in FIG. 12A and FIG. 12B, the attachment heights of the magnets 2 are all the same as each other and there is no leveling adjustment made with iron plates 11.

4-2 Operation

Operation of the composite speaker 106 according to the fourth exemplary embodiment is explained below.

When an audio signal is input to the voice coils 3 of the composite speaker 106, a changing magnetic field is generated in the voice coils 3, and the diaphragm 1 and the magnets 2 vibrate due to interaction between the changing magnetic field and the magnetic field of the magnets 2. Since the magnets 2 are also not directly fixed to the speaker base plate 6, and are instead attached through the yoke 4 and the elastic member 7, when the diaphragm 1 vibrates the speaker base plate 6 also vibrates. The audio signal is thereby converted into sound.

Figure 14:
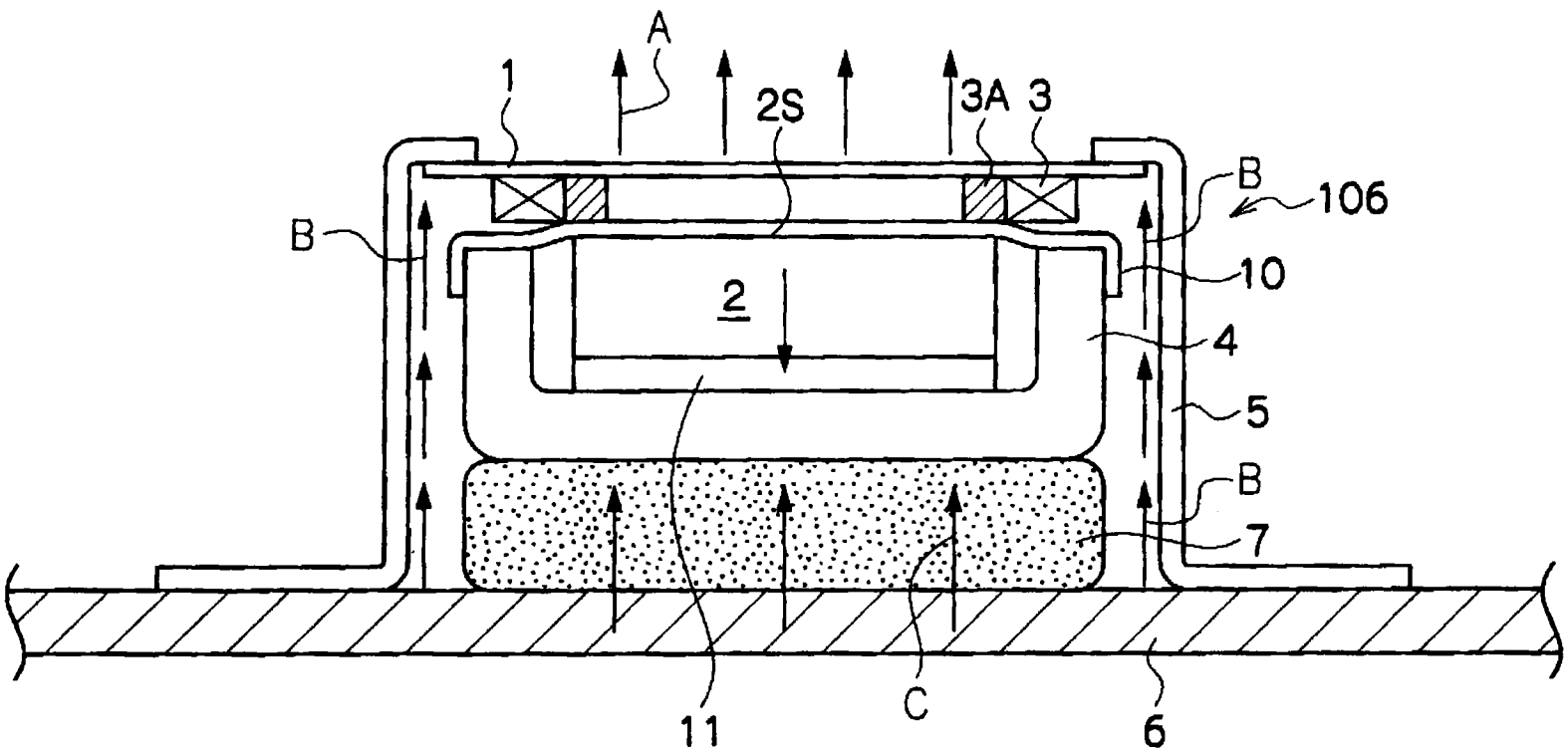
FIG. 14 is an explanatory diagram illustrating the operation of a composite speaker according to the fourth exemplary embodiment.

High pitched sound in the sound generated by the diaphragm 1 directly emits forwards, as indicated by arrow A in FIG. 14, namely directly emits upwards in FIG. 14. However low pitched sound therein passes through the frame 5 in the direction indicated by arrow B in FIG. 14 and propagates to the speaker base plate 6, so as to propagate externally through vibration of the speaker base plate 6. On the other hand, high frequencies in vibrations of the magnets 2 are absorbed by the elastic member 7 and are not transmitted to the speaker base plate 6. However the low frequencies therein are reversed in phase by the elastic member 7, and propagate to the speaker base plate 6 as vibrations as indicated by arrow C in FIG. 14 in the same phase as vibrations from the frame 5, such that low pitched sound is reproduced by vibration of the speaker base plate 6.

The composite speaker 106 of the fourth exemplary embodiment is thereby able to accurately reproduce both high pitched sound and low pitched sound with a single speaker, eliminating the need to provide a separate speaker such as a woofer for low pitched sound reproduction. Furthermore, due to the diaphragm 1 being configured in a flat plate shape rather than a cone shape, the composite speaker 106 can be made thinner compared with a cone-type speaker. The speaker can therefore be housed comfortably in a thin space such as a space between interior decor of a building or of a vehicle and a wall face.

5. Fifth Exemplary Embodiment

Figure 16:
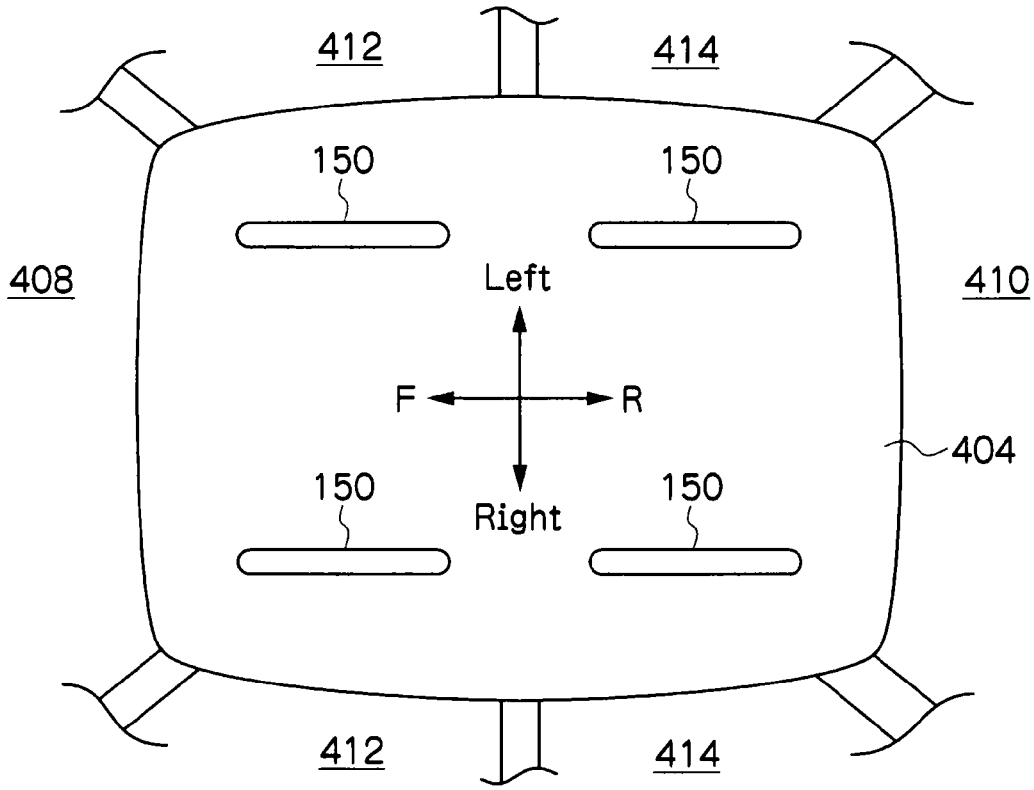
FIG. 16 is a plane view illustrating the ceiling of a vehicle provided with a car audio system according to the fifth exemplary embodiment, as viewed from below.
Figure 17:
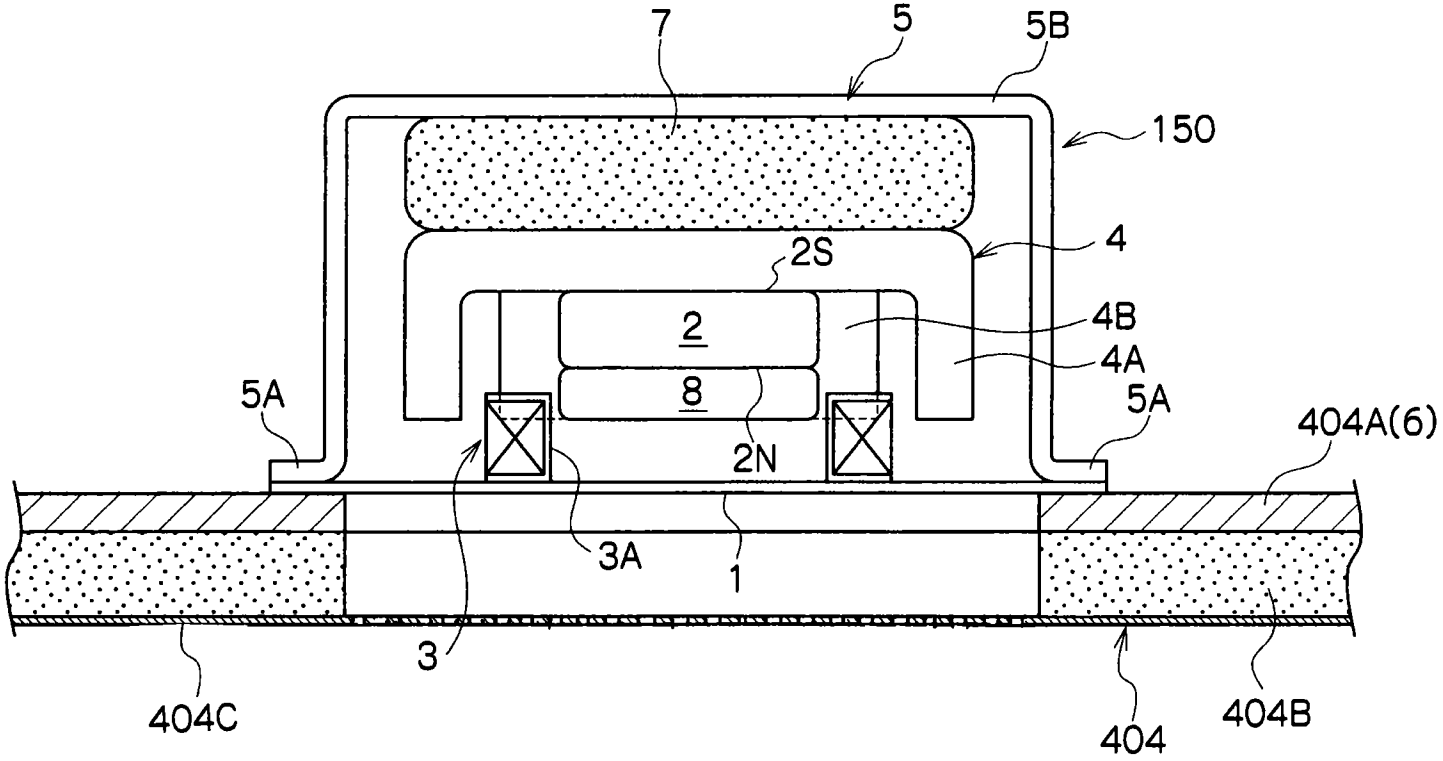
FIG. 17 is a cross-section illustrating a configuration of an example of a composite speaker employed in a car audio system according to the fifth exemplary embodiment.

A car audio system as an example of a vehicle audio system employing a composite speaker of the present invention is explained below. In FIG. 16 and FIG. 17, "F" indicates the front direction of a vehicle installed with the car audio system, "R" indicates the vehicle rear direction, "UP" indicates the vehicle top direction, and "DOWN" indicates the vehicle bottom direction. "Right" and "Left indicate respectively the right hand side and left hand side as viewed from the perspective of an occupant of the vehicle.

Figure 15:
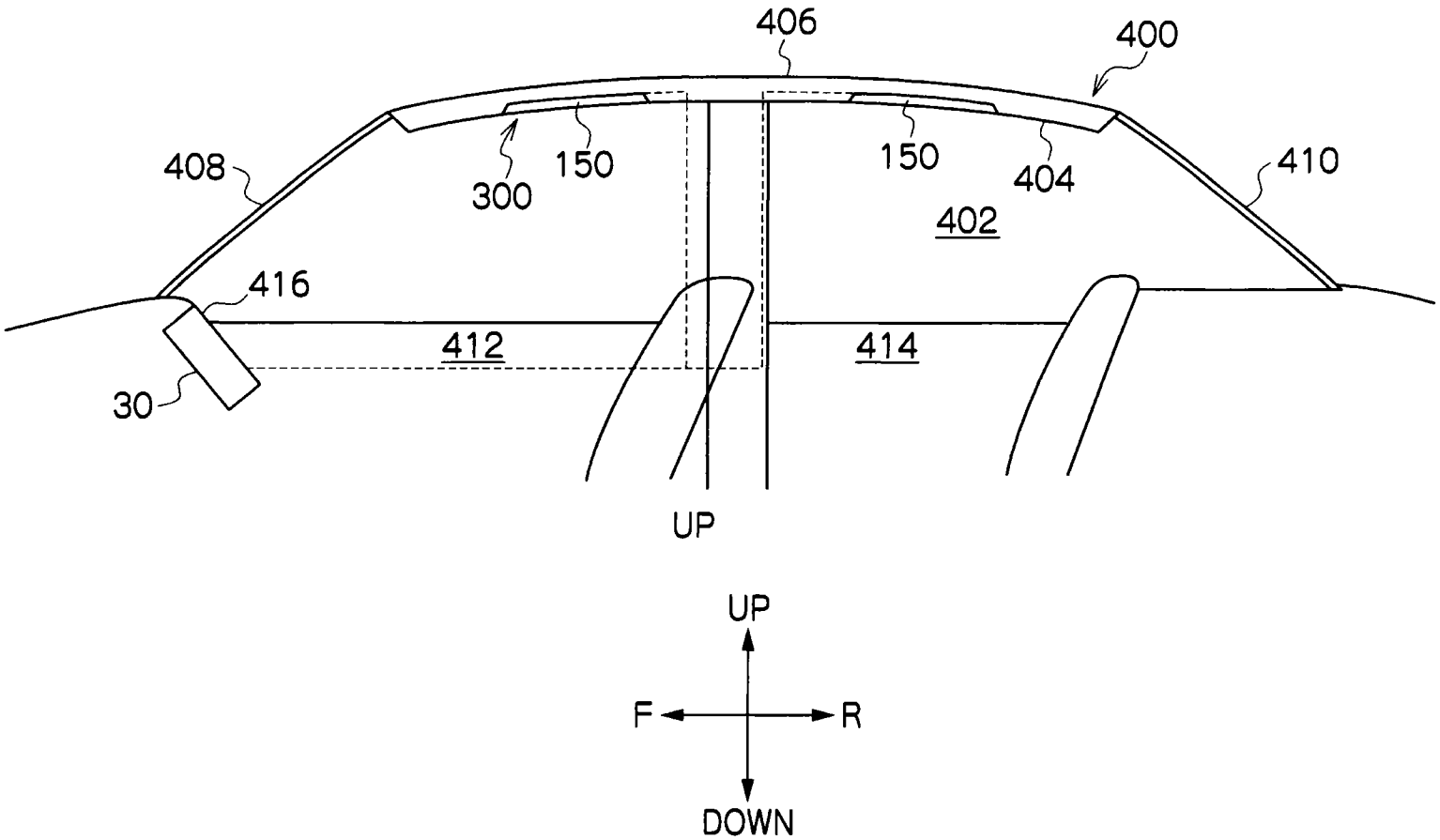
FIG. 15 is a cross-section taken along a vehicle front-rear direction plane illustrating a vehicle interior of a vehicle provided with a car audio system according to a fifth exemplary embodiment.

As shown in FIG. 15 and FIG. 16, a car audio system 300 according to a fifth exemplary embodiment includes: 4 individually installed composite speakers 150 or composite speakers 152, installed in a vehicle 400 along the vehicle front-rear direction at the right hand side and the left hand side of a ceiling 404 of a vehicle interior 402 surrounded by a front windshield 408, a rear window 410, front doors 412, rear doors 414, and a roof panel 406; and a car audio component 30 serving as audio signal generation means in a car audio system provided to a dashboard 416 of the vehicle 400. Each of the composite speakers 150 or the composite speakers 152 is electrically connected to the car audio component 30 and emits sound according to audio signals from the car audio component 30.

Figure 18:
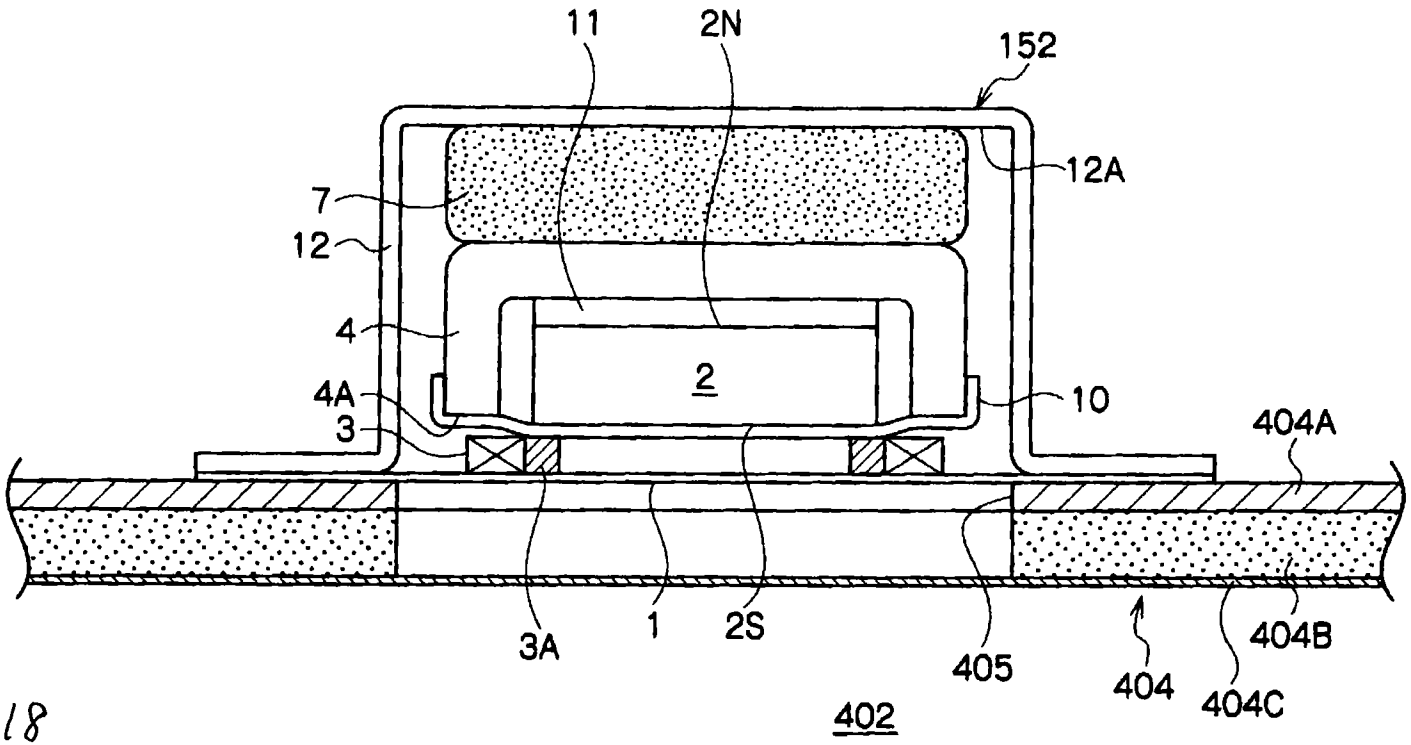
FIG. 18 is a cross-section illustrating a configuration of an example of a composite speaker employed in a car audio system according to the fifth exemplary embodiment.

The ceiling 404 is a molded ceiling, and as shown in FIG. 17 and FIG. 18, is configured from the vehicle interior 412 side with a covering 404C, a padding material 404B and a base material 404A.

Openings 405 for installing the composite speakers 150 or the composite speakers 152 are provided in the padding material 404B and the base material 404A. Holes are opened in portions of the covering 404C corresponding to the openings 405. Note that configuration may also be made with openings aligned with the openings 405 also provided in the covering 404C, with the openings in the covering 404C closed off with plates such as hole-punched metal plates.

The composite speakers 150 or the composite speakers 152 are installed to the outside face of the ceiling 404, namely to the face of the ceiling facing the roof panel 406 where the openings 405 are formed, and are installed such that the side of the frame 5, described later, to which a diaphragm 1 is fixed, faces toward inside the vehicle interior 412.

The composite speakers 150 or the composite speakers 152 are installed to the outside face of the ceiling 404, namely to the face of the ceiling facing the roof panel 406 where the openings 405 are formed, and are installed such that the side of the frame 12, described later, to which a diaphragm 1 is fixed, faces toward inside the vehicle interior 412.

Configuration of the composite speakers 150 is explained below.

As shown in FIG. 17, the composite speakers 150 include: the frame 5, the diaphragm 1 fixed to the frame 5, magnets 2 and a yoke 4 housed in a closed cross-section formed by the frame 5 and the diaphragm 1; and voice coils 3 fixed to the face of the diaphragm 1 facing towards the magnets 2.

The frame 5 is configured with an overall hat shaped cross-section, formed with flange portions 5A open towards the outside and a bottom face 5B. The diaphragm 1 is fixed to the flange portions 5A of the frame 5. The flange portions 5A are fixed to the base material 404A of the ceiling 404. However, configuration may be made such that the flange portions 5A are fixed to a speaker base plate 6 and the speaker base plate 6 is then fixed to the base material 404A when the base material 404A is formed from a material that does not readily transmit sound, such as a fiber material.

The voice coils 3 are fixed to the face of the diaphragm 1 on the side fixed to the frame 5, and the magnets 2 are disposed so as to face the voice coils 3.

The yoke 4 is disposed so as to make contact with the magnets 2 on the opposite side to the side of the magnets 2 facing towards the voice coils 3, and an elastic member 7 is interposed between the yoke 4 and the bottom face 5B of the frame 5. Pole pieces 8 are provided to the magnets 2 on the side facing towards the voice coils 3.

The magnets 2, the voice coils 3, the yoke 4, the elastic member 7 and the pole pieces 8 are configured as explained in the first exemplary embodiment.

In the composite speakers 150 the ceiling 404 functions as the speaker base plate 6.

Next, a configuration of the composite speakers 152 is explained below with reference to FIG. 18.

In the composite speakers 152, similarly to in the composite speakers 150, a frame 12 has an overall hat shaped cross-section, and a diaphragm 1 is fixed to the open side of the cross-section.

Voice coils 3 are fixed to the face of the diaphragm 1 on the side facing towards a bottom face 12A of the frame 12, and magnets 2 are disposed so as to face the voice coils 3.

A yoke 4 is disposed so as to make contact with the magnetic poles 2N that are on the opposite side of the magnets 2 to the magnetic poles 2S that face towards the voice coils 3. An elastic member 7 is interposed between the yoke 4 and the bottom face 12A of the frame 12.

The magnets 2, the voice coils 3, the yoke 4 and the elastic member 7 are configured as explained in the fourth exemplary embodiment.

In the composite speakers 152 the ceiling 404 corresponds to the speaker base plate of the present invention. However, configuration may be made such that the flange portions 5A are fixed to a speaker base plate 6 and the speaker base plate 6 is then fixed to the base material 404A when the base material 404A of the ceiling 404 is formed from a material that does not readily transmit sound, such as a fiber material.

Operation of the car audio system 300 according to the fifth exemplary embodiment is explained below.

When an audio signal is input from the car audio component 30 to the voice coils 3 of the composite speakers 150 or the composite speakers 152, a changing magnetic field is generated in the voice coils 3, and the diaphragm 1 vibrates due to interaction between the changing magnetic field and the magnetic field of the magnets 2. Since the magnets 2 are also not directly fixed to the speaker base plate 6, and are instead attached through the elastic member 7, when the diaphragm 1 vibrates the magnets 2 also vibrate at the same time. The audio signal is thereby converted into sound.

High pitched sound in the sound generated by the diaphragm 1 directly emits downwards, namely directly emits into the vehicle interior 412. However low pitched sound therein passes through the frame 12 and propagates to the ceiling 404, so as to propagate into the vehicle interior 412 by the ceiling 404 vibrating. High frequencies in vibrations of the magnets 2 are absorbed by the elastic member 7 and are not transmitted to the ceiling 404, however the low frequencies therein propagate to the ceiling 404 through the 7 and the frame 12, such that low pitched sound is reproduced by the ceiling 404 vibrating.

In the car audio system 300 of the fifth exemplary embodiment, the 4 individual composite speakers 150 or composite speakers 152 are thereby able to accurately reproduce both high pitched sound and low pitched sound, eliminating the need to provide a separate speaker such as a woofer for low pitched sound reproduction. Furthermore, due to the diaphragm 1 being configured in a flat plate shape rather than a cone shape, the composite speakers 150 or the composite speakers 152 can be formed as much thinner than a cone shaped speaker. The speaker can therefore be housed comfortably in a thin space such as the gap between the roof panel 406 and the ceiling 404 in the vehicle 400.

Since the composite speakers 150 or the composite speakers 152 are disposed on the left hand side and right hand side of the ceiling 404, sound can be heard coming from the upper left and the upper right of the occupant. Consequently, a much more vivid sensation can be achieved in comparison to conventional car audio systems with speakers installed on the left and right in the front doors 412 and the rear doors 414.

Note that the installation number of the composite speakers 150 or the composite speakers 152 is not limited to 4 in the car audio system 300 of the fifth exemplary embodiment. Configuration may be made such that when applied to a large vehicle such as for example a bus, a single row of the composite speakers 150 or the composite speakers 152 is disposed along the ceiling at the left side and the right side of the vehicle, giving a total of 2 rows, or configuration may also be made with a single row of speakers disposed at the left and right sides of the vehicle and along the center of the ceiling, giving a total of 3 rows.

6. Sixth Exemplary Embodiment

A further example of composite speakers included in the speakers of the present invention is explained below.

6-1 Configuration

Figure 19:
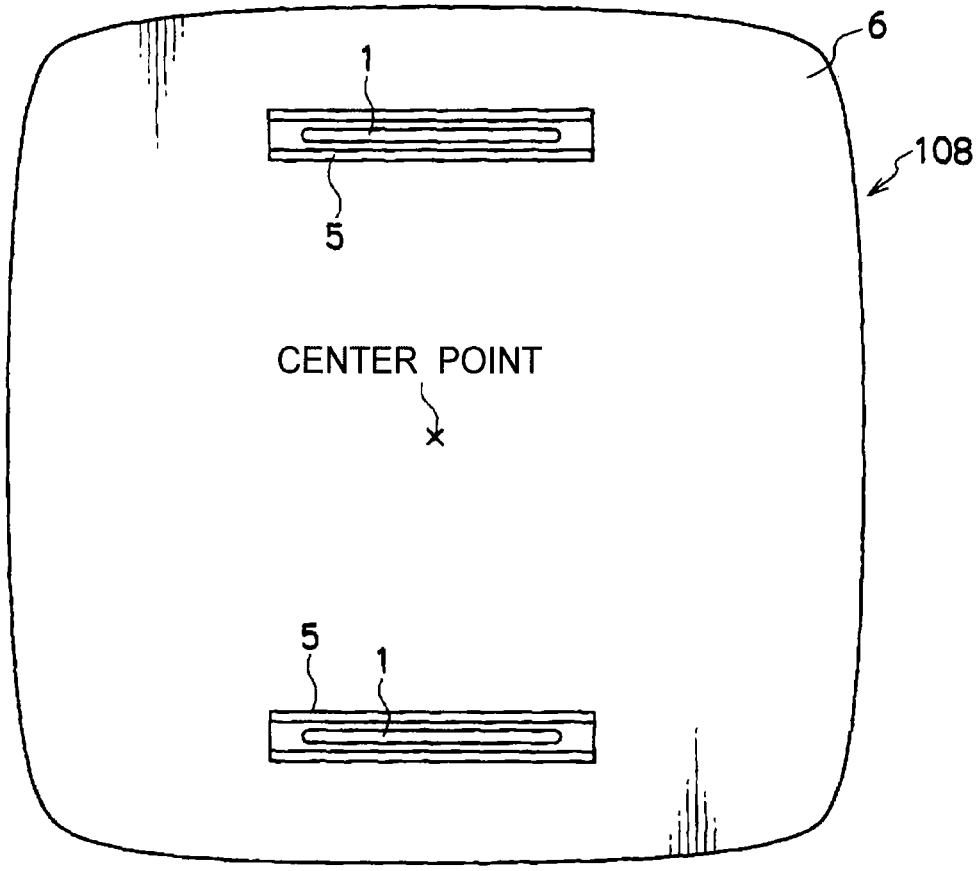
FIG. 19 is a plane view illustrating an example of a composite speaker according to the sixth exemplary embodiment.

In a composite speaker 108 according to a sixth exemplary embodiment, as shown in FIG. 19, the speaker base plate 6 is a plate shaped member having a flat plane shape with a high order curved profile as represented by the following equation, wherein the center point o of the speaker base plate 6 is positioned at the origin of xy coordinates, r is the radius and i is a number from 5 to 7:

$$r^i=|x|^i+|y|^i$$

Figure 20:
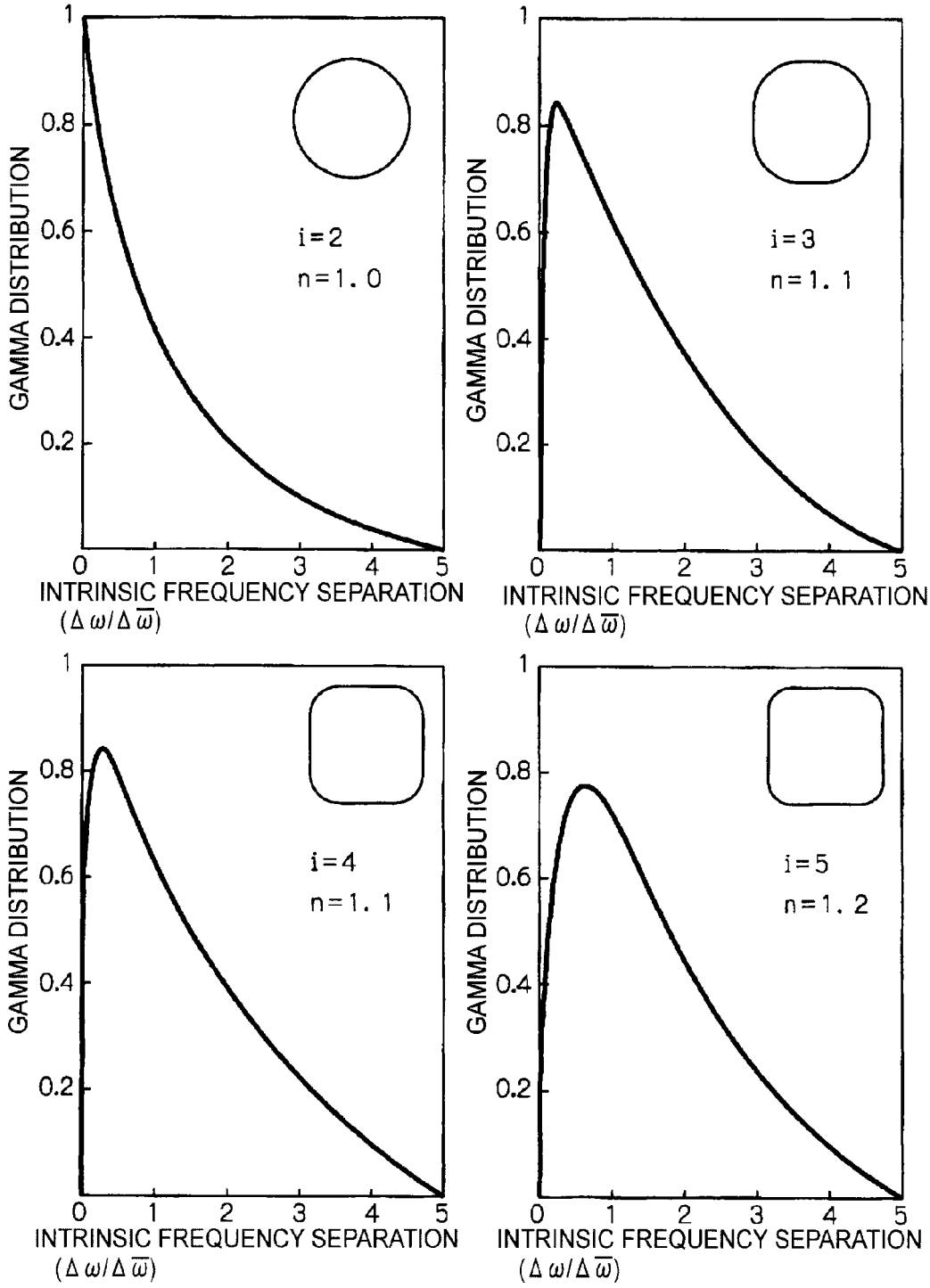
FIG. 20 shows graphs illustrating how the intrinsic frequency separation distribution for the speaker base plate illustrated in FIG. 19 changes when employing natural frequencies of 200 order to 500 order as the order number i is varied from 2 to 5.
Figure 21:
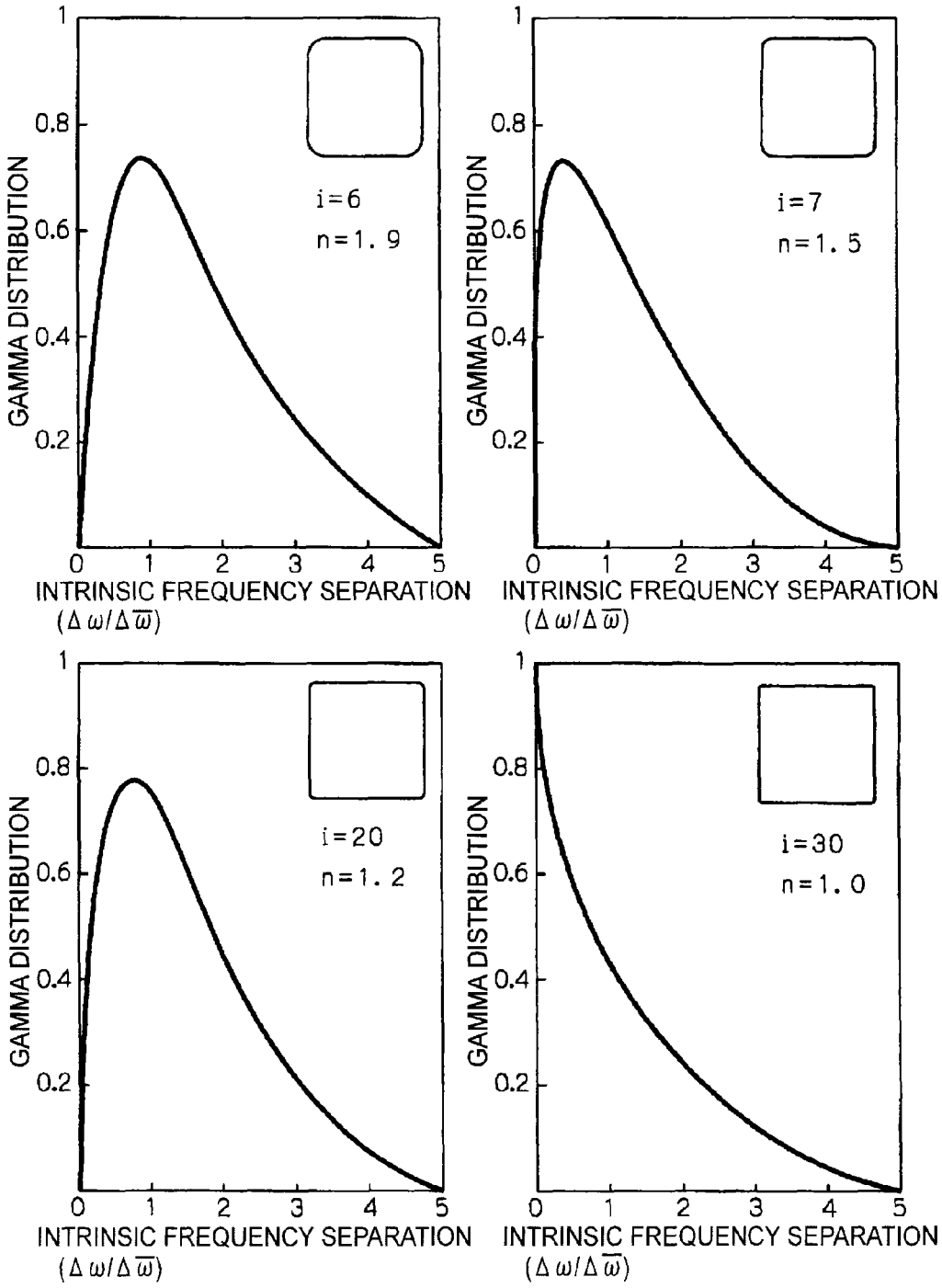
FIG. 21 shows graphs illustrating how the intrinsic frequency separation distribution for the speaker base plate illustrated in FIG. 19 changes when employing natural frequencies of 200 order to 500 order as the order number i is varied from 6 to 30.

By configuring the speaker base plate 6 with a flat plane shape as indicated above, the degrees of freedom n of a gamma distribution for fitting to an adjacent intrinsic frequency separation distribution, as shown in FIG. 20 and FIG. 21, are from 1.2 (when i=5) to 1.9 (when i=6), which is larger than the degrees of freedom n=1 when i=2 (a circular profile) or when i is infinitely large (a square shape). This is preferable since good sound separation arises for sound with different frequencies, in other words for sound of different pitches such as high pitched sound and low pitched sound. The order i is most preferably 6.

Instead of employing a speaker base plate 6 having uniform density and thickness distribution, by controlling a density or thickness distribution of the speaker base plate 6 or by fitting a weight onto the speaker base plate, a vibration property similar to that of a speaker base plate 6 having a flat plane shape with a high order curved profile can be provided to the speaker base plate 6. In such a speaker base plate 6, the flat plate shape is not necessarily a high order curved profile.

The frame 5 may be configured as a whole with a linear profile flat plate shape, or may be configured as a whole with a ring shape, specifically as a flat plate shape with a circular ring profile.

The frames 5 may, as shown in FIG. 19, be disposed along two opposing sides of the speaker base plate 6, may be disposed along every side of the speaker base plate 6, or one or two pairs of the frames 5 may be disposed on the diagonal lines of the speaker base plate 6. However it is preferable to dispose the frames 5 symmetrically about the central point of the speaker base plate 6.

In cases in which the frame 5 is a ring shaped body, a single frame 5 alone may be disposed at a central portion of the speaker base plate 6, or one or two pairs of the frames 5 may be disposed on the diagonal line(s) of the speaker base plate 6. However it is preferable to dispose the frames 5 symmetrically about the central point of the speaker base plate 6.

The frame 5 has a hat shape in cross-section in cases in which the frame 5 has a linear profile flat plane shape, and also in cases in which the frame 5 has a ring profile flat plane shape. Accordingly, the yoke 4, the magnets 2 and the elastic member 7 are housed in the space between the frame 5 and the speaker base plate 6 in both cases.

The yoke 4, the diaphragm 1, the magnets 2, the elastic member 7 and the voice coils 3 are configured as described in the first exemplary embodiment to the fourth exemplary embodiment.

6-2 Operation

Operation of the composite speaker 108 according to the sixth exemplary embodiment is explained below.

When an audio signal is input to the voice coils 3 of the composite speaker 108, a changing magnetic field is generated in the voice coils 3, and the diaphragm 1 vibrates due to interaction between the changing magnetic field and the magnetic field of the magnets 2. Since the magnets 2 are also not directly fixed to the speaker base plate 6, and are instead attached through the yoke 4 and the elastic member 7, when the diaphragm 1 vibrates the speaker base plate 6 also vibrates. The audio signal is thereby converted into sound.

High pitched sound in the sound generated by the diaphragm 1 directly emits forwards, however low pitched sound therein passes through the frame 5 and propagates to the speaker base plate 6, so as to propagate externally due to the speaker base plate 6 vibrating. High frequencies in vibrations of the magnets 2 are absorbed by the elastic member 7 and are not transmitted to the speaker base plate 6, however the low frequencies therein propagate to the speaker base plate 6 through the elastic member 7, such that low pitched sound is reproduced by the speaker base plate 6 vibrating.

FIG. 20 to FIG. 21 illustrate how the intrinsic frequency separation distribution for the speaker base plate 6 changes when employing natural frequencies of 200 to 500 order as the order number i is varied from 2 to 30. The horizontal axes in FIG. 20 and FIG. 21 are the intrinsic frequency separation $s=(\Delta\omega/\text{average value of }\Delta\omega)$, and the vertical axes indicate the distribution.

In cases of the speaker base plate 6 in which the order number i is 2 (a circular profile) and the order number of i is 30 (a substantially square shaped profile), since the degrees of freedom n=1 for the gamma distribution for fitting to the adjacent intrinsic frequency distribution, vibration is regular and it can be seen from FIG. 20 and FIG. 21 that there is a high degree of attenuation for high pitched sound.

In contrast, when the order number i of the speaker base plate 6 is 5 to 7, the degrees of freedom n of the gamma distribution are 1.2 or greater, and the degrees of freedom n are at a maximum of 1.9 when the order i=6. It can be seen from FIG. 20 and FIG. 21 that in these cases, there is smaller attenuation of high pitched sound than when the order number i of the base plate is less than 4 or greater than 8.

It can hence be seen that the composite speaker 108 of the sixth exemplary embodiment is thereby able to accurately reproduce both high pitched sound and low pitched sound with a single speaker, eliminating the need to provide a separate speaker such as a woofer for low pitched sound reproduction. Furthermore, due to the diaphragm 1 being configured not in a conical shape but in a flat plate shape, the composite speaker 108 can be made much thinner compared with a cone shaped speaker.

EXPLANATION OF THE REFERENCE NUMERALS

1 DIAPHRAGM
2 MAGNET
2N MAGNETIC POLE
2S MAGNETIC POLE
3 VOICE COIL
3A BOBBIN
4 YOKE
4A FIRST BENT PORTION
4B SECOND BENT PORTION
5 FRAME
6 SPEAKER BASE PLATE
7 ELASTIC MEMBER
8 POLE PIECES
100,102, 104, 106, 108, 150, 152 COMPOSITE SPEAKER
300 CAR AUDIO SYSTEM
400 VEHICLE
404 CEILING

The invention claimed is:

1. A composite speaker comprising:
a plurality of magnets disposed at predetermined intervals;
a yoke that forms a magnetic circuit having a magnetic gap with respect to the magnets;
a voice coil disposed in the gap between the magnets and the yoke so as to interlink with the magnetic circuit;
a diaphragm with the voice coil fixed to one face thereof;
a frame to which peripheral edge portions of the diaphragm are directly fixed and that houses the magnets and the yoke;
a speaker base plate fixed to the frame at a side thereof opposite to a side supporting the diaphragm; and
an elastic member formed from an elastic material selected from the group consisting of a thermoplastic elastomer, a vulcanized rubber and a soft resin, or formed from a foamed body of an elastic material selected therefrom, and inserted between a base face of the yoke and the speaker base plate;
wherein sound is generated from both the diaphragm and the speaker base plate.

2. The composite speaker of claim 1, wherein the magnets are disposed in a row such that two adjacent magnet poles are the reverse of each other.

3. The composite speaker of claim 2, wherein the speaker base plate has a flat plate shape with a high order curve profile represented by the following equation, wherein the center point of the speaker base plate is at the origin of xy coordinates, r is the radius, and i is a number from 5 to 7:

$$r^i=|x|^i+|y|^i.$$

4. The composite speaker of claim 2, wherein the diaphragm and the frame are formed from aluminum alloy.

5. The composite speaker of claim 1, further comprising a back plate provided between the speaker base plate and both the frame and the elastic member.

6. The composite speaker of claim 5, wherein the diaphragm and the frame are formed from aluminum alloy.

7. The composite speaker of claim 1, wherein the speaker base plate has a flat plate shape with a high order curve profile represented by the following equation, wherein the center point of the speaker base plate is at the origin of xy coordinates, r is the radius, and i is a number from 5 to 7:

$$r^i=|x|^i+|y|^i.$$

8. The composite speaker of claim 1, wherein the diaphragm and the frame are formed from aluminum alloy.

9. A composite speaker comprising:
a plurality of magnets disposed at predetermined intervals;
a yoke that forms a magnetic circuit having a magnetic gap with respect to the magnets;
a voice coil disposed in the gap between the magnets and the yoke so as to interlink with the magnetic circuit;
a diaphragm with the voice coil fixed to one face of the diaphragm;
a frame to which peripheral edge portions of the diaphragm are directly fixed and that houses the magnets and the yoke;
a speaker base plate fixed to the frame at a side thereof supporting the diaphragm; and an elastic member formed from an elastic material selected from the group consisting of a thermoplastic elastomer, a vulcanized rubber and a soft resin, or formed from a foamed body of an elastic material selected therefrom, and inserted between a base face of the yoke and a base face of the frame;

wherein sound is generated from both the diaphragm and the speaker base plate.

10. The composite speaker of claim 9, further comprising a back plate provided between the speaker base plate and both the frame and the elastic member.

11. The composite speaker of claim 10, wherein the diaphragm and the frame are formed from aluminum alloy.

12. The composite speaker of claim 9, wherein the speaker base plate has a flat plate shape with a high order curve profile represented by the following equation, wherein the center point of the speaker base plate is at the origin of xy coordinates, r is the radius, and i is a number from 5 to 7:

$$r^i=|x|^i+|y|^i.$$

13. The composite speaker of claim 9, wherein the diaphragm and the frame are formed from aluminum alloy.

* * * * *